US006312120B1

(12) United States Patent
Ando et al.

(10) Patent No.: US 6,312,120 B1
(45) Date of Patent: Nov. 6, 2001

(54) PRINTER

(75) Inventors: Makoto Ando; Yoshinori Ito; Emi Yamada, all of Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/407,717

(22) Filed: Sep. 28, 1999

Related U.S. Application Data

(63) Continuation of application No. 08/947,535, filed on Oct. 10, 1997.

(30) Foreign Application Priority Data

Oct. 14, 1996 (JP) ..... 8-271154

(51) Int. Cl.[7] ..... B41J 2/17

(52) U.S. Cl. ..... 347/95; 347/40; 347/47; 347/44

(58) Field of Search ..... 347/95, 100, 20, 347/40, 47, 44

(56) References Cited

U.S. PATENT DOCUMENTS

| | | | | |
|---|---|---|---|---|
| 4,415,909 | * | 11/1983 | Italiano et al. | 347/40 |
| 5,777,636 | * | 7/1998 | Naganuma et al. | 347/20 |
| 5,958,122 | * | 9/1999 | Fukuda et al. | 347/95 |
| 6,086,196 | * | 7/2000 | Ando et al. | 347/95 |

FOREIGN PATENT DOCUMENTS 0 655 337 A2 5/1995 (EP) .

0 737 585 A1 10/1996 (EP) .

* cited by examiner

*Primary Examiner*—John Barlow
*Assistant Examiner*—M S Shah
(74) *Attorney, Agent, or Firm*—Bell, Boyd & Lloyd LLC

(57) ABSTRACT

The present invention provides a printer which enables to prevent dispersion of a quantitative medium in a discharge medium during a wait period of time, so as to realize an accurate quantification of the quantitative medium to be mixed with the discharge medium, which enables an accurate gradation expression.

The printer includes a printing head having quantitative nozzle communicating with a quantitative medium pressure chamber into which a quantitative medium is introduced and a discharge medium nozzle communicating with a discharge medium pressure chamber into which a discharge medium is introduced. The quantitative medium is made to seep out from the quantitative medium nozzle toward the discharge medium nozzle and after this, the discharge medium is discharged from the discharge medium nozzle to be mixed with the quantitative medium so that the mixture obtained is discharged. The quantitative medium nozzle have an opening of, for example, a crescent shape, i.e., a circular shape with a cut-off portion, and is positioned in such a manner that the nearest point on the opening end of the quantitative medium nozzle from the center of figure of the quantitative medium nozzle faces the discharge medium nozzle which opens adjacently.

3 Claims, 21 Drawing Sheets

FIG.25A
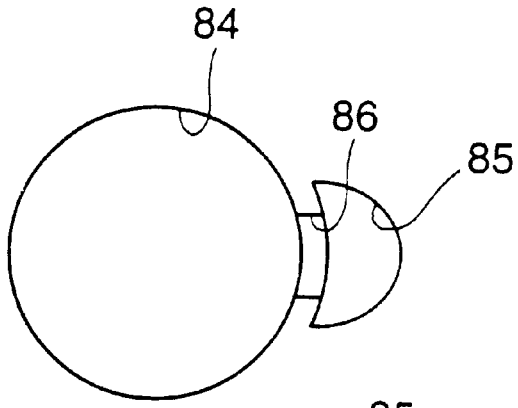
FIG.25B
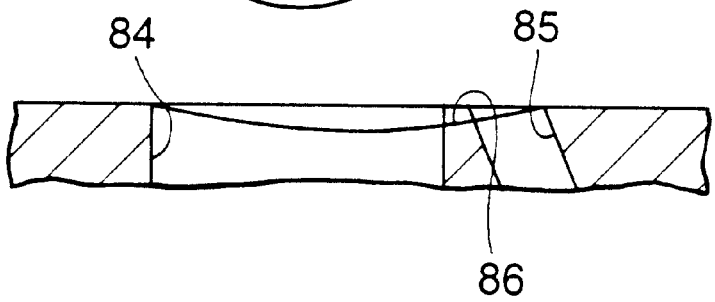
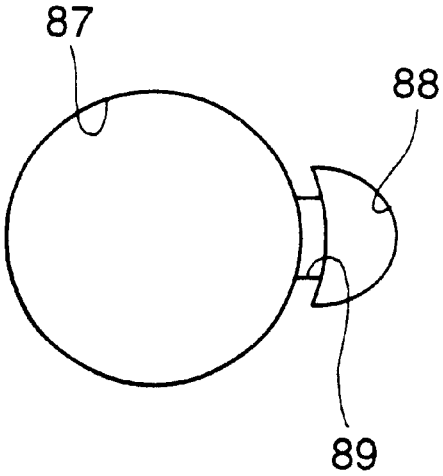
FIG.26

PRINTER

This application is a continuation of application Ser. No. 08/947,535 filed Oct. 10, 1997.

BACKGROUND OF THE INVENTION

1. Field of the Invention

The present invention relates to a printer for mixing and discharging a quantitative medium and a discharge medium, and more particularly, to a printer capable of forming an image of a high resolution as well as enhancing the productivity.

2. Description of the Prior Art

In recent years, especially in business offices, "desktop publishing", i.e., document creation using a computer is widely spread, and a demand has been increased recently for outputting not only characters and graphics but also a color natural image such as a photograph together with characters and graphics. In order to answer such a demand, it has become necessary to print out a natural image of high quality requiring reproduction of halftones.

Moreover, a so-called on-demand type printer is being rapidly spread. This is a printer, in which, according to a control signal outputted according to a recording signal, an ink droplet is discharged from a nozzle and applied to a medium such as a paper and a film only when necessary during a printing. Such a printer has a possibility to be reduced in size and cost.

For discharging an ink droplet, various methods have been suggested. Among them the most popular method employs a piezoelectric device or a heating device. The former is a method for discharging ink by applying a pressure to the ink by deformation of the piezoelectric device. The latter is a method for discharging ink by pressure of foams generated in the ink heated to evaporate by the heating device.

Also, there have been suggested various methods for approximately reproducing gradation steps with the aforementioned halftones by using the on-demand type printer which discharges the aforementioned ink droplet. As a first method, the voltage level or pulse width of the voltage pulse to be applied to the piezoelectric device or the heating device is changed so as to control the size of the droplet to be discharged and to change the diameter of a printed dot.

However, this method has a problem that if the voltage level or pulse width to be applied to the piezoelectric device or the heating device is decreased too much, ink discharging is disabled. Consequently, the minimum droplet diameter has a limitation, decreasing the number of gradation steps which can be expressed and disabling expression of a low concentration. That is, this method is insufficient for printing out a natural image.

A second method does not change a dot diameter but employs a pixel composed of a matrix of, for example, 4×4 dots. Gradation expression is realized on this matrix base by using an image processing method such as a so-called dither method and error diffusion method.

This second method also enables to express 17 gradation steps when a single pixel is composed of a 4×4 matrix. However, this method also has a problem. For example, if a printing is carried out with the same dot density as in the first method, the resolution is decreased to ¼ of the first method, and only a rough image can be obtained. That is, this method is also insufficient for printing out a natural image.

In order to eliminate these problems, the inventors of-the present invention have suggested a printer disclosed in Japanese Patent Laid-Open Hei 5-201024 and Japanese Patent Laid-Open Hei 7-195682 in which ink is mixed with diluent, i.e., a transparent solvent, at a predetermined mixture ratio immediately before discharging and the diluted ink is discharged from a nozzle onto a recording material. Hereinafter, the term "carrier jet method" will be used to denote a printing method in which ink which is a quantitative medium is mixed with diluent which is a discharge medium and the discharge medium is discharged for carrying out recording. It should be noted that there is not problem in the aforementioned printer if the diluent is assumed to be a quantitative medium and the ink is assumed as a discharge medium.

In such a carrier jet type printer, the quantity of the quantitative medium which is either ink or diluent is changed so as to change the mixture ratio of ink and diluent for controlling the concentration of a liquid mixture droplet discharged, enabling to modify the concentration of a printed dot. That is, the printer is capable of printing out a natural image having a plenty of half tones without deteriorating the resolution.

As such a printer of two-liquid mixing type, there can be exemplified a printer of so-called internal mixing type. This printer includes at least a discharge medium pressure chamber into which a discharge medium is introduced; a discharge medium nozzle which communicates with the discharge chamber; a quantitative medium pressure chamber into which a quantitative medium is introduced; and a connection section which connects the quantitative medium pressure chamber with the discharge medium nozzle. In this printer, the quantitative medium in the quantitative medium pressure chamber is introduced into the connection section where the quantitative medium is mixed with the discharge medium in the discharge medium nozzle, i.e., a liquid mixture is obtained from the quantitative medium and the discharge medium in the discharge medium nozzle, and the liquid mixture is discharged from the discharge medium nozzle.

However, in the aforementioned printer of internal mixing type, there is a problem that during a wait period when no mixing is to be carried out between the quantitative medium and the discharge medium, the quantitative medium is readily dispersed into the discharge medium in the discharge medium nozzle. Moreover, there is a problem that during a mixing-discharging operation for mixing the quantitative medium with the discharge medium, an unnecessary portion of discharge medium flows into the connection section or an unnecessary portion of the quantitative medium flows into the discharge medium.

If dispersion occurs between a quantitative medium and a discharge medium, the discharge medium which is, for example, diluent is gradually colored, whereas the quantitative medium which is, for example, ink is diluted. This affects the concentration of a mixture droplet discharged and it becomes difficult to adjust an accurate concentration gradation.

The aforementioned flow-in of an unnecessary portion of the quantitative medium or the discharge medium is caused as follows, assuming that the quantitative medium is ink and the discharge medium is diluent. When a liquid mixture of a very low concentration is successively discharged, a pressure functions so that the diluent gradually intrudes into the connection section into which ink is introduced. On the contrary, when a liquid mixture of a very high concentration is successively discharged, a pressure functions so that the ink gradually intrudes into the discharge medium nozzle. In the former case, a mixture droplet of a low concentration is discharged when a mixture of a high concentration is to be discharged. In the latter case, a mixture droplet of a high concentration is discharged when a mixture of a low concentration is to be discharged. This makes it difficult to obtain an accurate concentration gradation.

To cope with this problem, the conventional printer employs a one-way valve made by electrofoming or the like, at the boundary between the connection section which is supplied with a quantitative medium and the discharge medium nozzle, so as to prevent dispersion of the quantitative medium and the discharge medium during a wait period as well as to prevent flow-in and mixing of unnecessary portions of the discharge medium and the quantitative medium during a mixing-discharging operation.

However, the aforementioned one-way valve cannot completely shut out the quantitative medium and the discharge medium from each other during a wait period or completely prevent an unnecessary flow-in of the quantitative medium and the discharge medium during a mixing-discharging operation. Thus, there is a difficulty to obtain an accurate concentration gradation. Moreover, employment of such a one-way valve increases the production cost, deteriorating the productivity.

Under these circumstances, there has been suggested a so-called printer of external mixing type as follows. This printer includes a quantitative medium pressure chamber into which a quantitative medium is introduced; a discharge medium pressure chamber into which a discharge medium is introduced; a quantitative medium nozzle which communicates with the quantitative medium pressure chamber; and a discharge medium nozzle which communicates with the discharge medium pressure chamber, wherein the quantitative medium nozzle and the discharge medium nozzle have openings adjacent to each other. A quantitative medium comes out of the quantitative nozzle, seeping along the nozzle opening so as to be brought into contact with the discharge medium introduced to a vicinity of the nozzle opening, so that a liquid mixture is obtained before the discharge medium is discharged from the discharge medium nozzle, thus discharging the quantitative medium and the discharge medium as a liquid mixture.

Because the quantitative medium nozzle and the discharge medium nozzle are formed separately from each other, there is no problem of dispersion of the quantitative medium and the discharge medium during a wait period, and the unnecessary flow-in during a mixing-discharging operation can also be prevented.

As has been described above, in a printer in which a quantitative medium which is, for example, ink and a discharge medium which is, for example, diluent are mixed to be discharged, it is necessary to accurately control the mixing ratio of the ink and the diluent in order to accurately express a gradation step according to an image data.

In order to achieve this, it is necessary that the ink is completely separated from the diluent during a wait state when no mixing is to be carried out between the ink and the diluent. If the ink is in contact with the diluent during the wait state, the ink flows into the nozzle of diluent and the diluent flows into the nozzle of the ink. This adversely affects the mixing ratio of the ink and the diluent for the following dot, disabling to accurately express a gradation step, and it is difficult to obtain a recorded image of a high resolution.

It is indispensable to accurately carry out seeping of the quantitative medium from the quantitative medium nozzle, from which the quantitative medium is pushed out, toward the discharge medium nozzle, from which the discharge medium is discharged, as well as the discharging of the discharge medium from the discharge medium nozzle so as to be mixed with the quantitative medium to be discharged together. For this, it is necessary to surely mix a predetermined quantity of the quantitative medium with the discharge medium in the discharge medium nozzle.

SUMMARY OF THE INVENTION

It is therefore an object of the present invention to provide a printer which enables to prevent mixing of a quantitative medium and a discharge medium due to dispersion during a wait period so that an accurate quantity of the quantitative medium according to a gradation step is mixed with the discharge medium, enabling an accurate gradation expression.

In order to achieve the aforementioned object, the present invention provides a printer including a printing head having: a discharge medium pressure chamber into which a discharge medium is introduced; a quantitative medium pressure chamber into which a quantitative medium is introduced; a discharge medium nozzle which communicates with the discharge medium pressure chamber; and a quantitative medium nozzle which communicates with the quantitative medium pressure chamber; the discharge medium nozzle and the quantitative nozzle having openings adjacent to each other, wherein the quantitative medium is made to seep out from the quantitative medium nozzle toward the discharge medium nozzle and after this, the discharge medium is discharged from the discharge medium nozzle so as to be mixed with the quantitative medium so that a mixture obtained is discharged, the printer being characterized in that the opening of the quantitative medium nozzle has such a configuration that the distance between the center of the-smallest circle including the opening and the nearest point on the opening of the discharge medium nozzle is smaller than the distance between the center of the largest circle included in the opening and the nearest point on the opening of the discharge medium nozzle.

Note that, hereinafter, the "smallest circle including the opening of the quantitative medium nozzle" will be referred to as a circumscribed circle of the opening, whereas the "largest circle included in the opening of the quantitative nozzle" will be referred to as an inscribed circle of the opening of the quantitative medium nozzle.

In this printer according to the present invention, it is preferable that the quantitative medium nozzle have an opening of a crescent shape.

In this printer according to the present invention, an opening of one discharge medium nozzle may be surrounded by openings of a plurality of quantitative nozzles.

In this printer according to the present invention, a groove portion may be formed so as to connect the opening of the discharge medium nozzle with the opening of the quantitative medium nozzle.

In this printer according to the present invention, it is preferable that the discharge medium nozzle and the quantitative medium nozzle be formed in a plate-shaped member and the discharge medium is mixed with the quantitative medium on the plate-shaped member.

In this printer according to the present invention, it is preferable that a surface of the plate-shaped member where the nozzles open be treated so as to have a liquid repellent property.

In this case, it is preferable that a region between the opening of the discharge medium nozzle and the opening of the quantitative medium nozzle has been treated so as to have a non-liquid-repellent property or a hydrophilic property.

A printer according to another embodiment of the present invention includes a printing head having: a discharge medium pressure chamber into which a discharge medium is introduced; a quantitative medium pressure chamber into which a quantitative medium is introduced; a discharge medium nozzle which communicates with the discharge medium pressure chamber; and a quantitative medium nozzle which communicates with the quantitative medium pressure chamber; the discharge medium nozzle and the quantitative nozzle having openings adjacent to each other, wherein the quantitative medium is made to seep out from the quantitative medium nozzle toward the discharge medium nozzle and after this, the discharge medium is discharged from the discharge medium nozzle so as to be mixed with the quantitative medium so that a mixture obtained is discharged, the printer being characterized in that the opening of the quantitative medium nozzle has such a configuration that a cut-off portion of the opening faces the discharge medium nozzle which opens adjacently.

In this printer according to another embodiment of the present invention, it is preferable that the quantitative medium nozzle have an opening of a symmetric configuration with respect to a line connecting the center of the opening of the discharge medium nozzle with the center of figure of the opening when the cut-off portion is restored.

In this printer according to another embodiment of the present invention, the quantitative medium nozzle may a circular opening or a polygonal opening when the cut-off portion is restored.

In this case, it is preferable that the cut-off portion be an arc shape with or without an angled corner.

More specifically, it is preferable that the quantitative medium nozzle have a crescent-shaped opening.

In the printer according this embodiment of the present invention, an opening of one discharge medium nozzle may be surrounded by openings of a plurality of quantitative nozzles.

Moreover, in the printer according to this embodiment of the present invention, a groove portion may be formed so as to connect the opening of the discharge medium nozzle with the opening of the quantitative medium nozzle.

Furthermore, in the printer according to this embodiment of the present invention, it is preferable that the discharge medium nozzle and the quantitative medium nozzle be formed in a plate-shaped member and the discharge medium is mixed with the quantitative medium on the plate-shaped member.

In the printer according to this embodiment of the present invention, the discharge medium nozzle and the quantitative medium nozzle are preferably formed in a plate-shaped member and a surface of the plate-shaped member where the nozzles open has been treated so as to have a liquid repellent property.

In this case, a region between the opening of the discharge medium nozzle and the opening of the quantitative medium nozzle may be treated so as to have a non-liquid-repellent property or a hydrophilic property.

According to still another embodiment of the present invention, there is provided a printer including a printing head having: a discharge medium pressure chamber into which a discharge medium is introduced; a quantitative medium pressure chamber into which a quantitative medium is introduced; a discharge medium nozzle which communicates with the discharge medium pressure chamber; and a quantitative medium nozzle which communicates with the quantitative medium pressure chamber; the discharge medium nozzle and the quantitative nozzle having openings adjacent to each other, wherein the quantitative medium is made to seep out from the quantitative medium nozzle toward the discharge medium nozzle and after this, the discharge medium is discharged from the discharge medium nozzle so as to be mixed with the quantitative medium so that a mixture obtained is discharged, the printer being characterized in that the opening of the quantitative medium nozzle has such a configuration that the nearest point on the opening end of the quantitative medium nozzle from the center of figure of the opening is positioned so as to face the discharge medium nozzle which opens adjacently.

In this printer according to the present invention, it is preferable that the quantitative medium nozzle have an opening of a crescent shape.

In this printer according to the present invention, an opening of one discharge medium nozzle may be surrounded by openings of a plurality of quantitative nozzles.

In this printer according to the present invention, a groove portion may be formed so as to connect the opening of the discharge medium nozzle with the opening of the quantitative medium nozzle.

In this printer according to the present invention, the discharge medium nozzle and the quantitative medium nozzle are preferably formed in a plate-shaped member and the discharge medium is mixed with the quantitative medium on the plate-shaped member.

In this printer according to the present invention, a surface of the plate-shaped member where the nozzles open is preferably treated so as to have a liquid repellent property.

In this case, a region between the opening of the discharge medium nozzle and the opening of the quantitative medium nozzle is preferably treated so as to have a non-liquid-repellent property or a hydrophilic property.

In the printer according to an aspect of the present invention, the quantitative medium nozzle for pushing out a quantitative medium is provided separately from the discharge medium nozzle for discharging the discharge medium. Consequently, during a wait period of time, the quantitative medium will not be brought into contact with the discharge medium, and they are assured to be separated from each other. Moreover, during a mixing-discharging operation, no unnecessary flow-in of the quantitative medium and the discharge medium into wrong nozzles will not be caused.

In the printer according to another aspect of the present invention, the quantitative medium nozzle has an opening adjacent to an opening of the discharge medium nozzle. Consequently, the quantitative medium which seeps out from the quantitative medium nozzle is assured to be supplied to the discharge medium nozzle.

In the printer according to still another aspect of the present invention, the opening of the quantitative medium nozzle has such a configuration that the distance between the center of the circumscribed circle of this opening and the nearest point on the opening of the discharge medium nozzle is smaller than the distance between the center of the inscribed circle of this opening and the nearest point on the opening of the discharge medium nozzle. Consequently, the quantitative medium is assured to be pushed out toward the discharge medium nozzle.

In the printer according to yet another aspect of the present invention, the opening of the quantitative medium nozzle has such a configuration that the nearest point on the opening end of the quantitative medium nozzle from the center of figure faces the adjacent discharge medium nozzle. Consequently, the quantitative medium is further assured to be pushed out toward the discharge medium nozzle.

In the printer according to still yet another aspect of the present invention, the opening of the quantitative medium nozzle has such a configuration that a cut-off portion faces the discharge medium nozzle. Consequently, the quantitative medium is still further assured to be pushed out toward the discharge medium nozzle through this cut-off portion.

It should be noted that the quantitative medium is still further assured to be pushed out toward the discharge medium nozzle on the condition that the discharge medium nozzle opening and the quantitative medium nozzle are arranged symmetrically with respect to a line connecting the center of the discharge medium nozzle opening and the center of the quantitative medium opening when the cut-off portion is restored.

BRIEF DESCRIPTION OF THE DRAWINGS

FIG. 25 is a schematic plan view and a cross sectional view showing the discharge medium nozzle and the quantitative medium nozzle of the printing head of the printer according to yet another modification of the embodiment of the present invention.

FIG. 26 is a schematic plan view showing the discharge medium nozzle and the quantitative medium nozzle of the printing head of the printer according to yet still another modification of the embodiment of the present invention.

DETAILED DESCRIPTION OF THE PREFERRED EMBODIMENTS

Description will now be directed to embodiments of the present invention with reference to the attached drawings. Note that explanation will given on a so-called carrier jet type printer using ink as a quantitative medium and diluent as a discharge medium.

Figure 1:
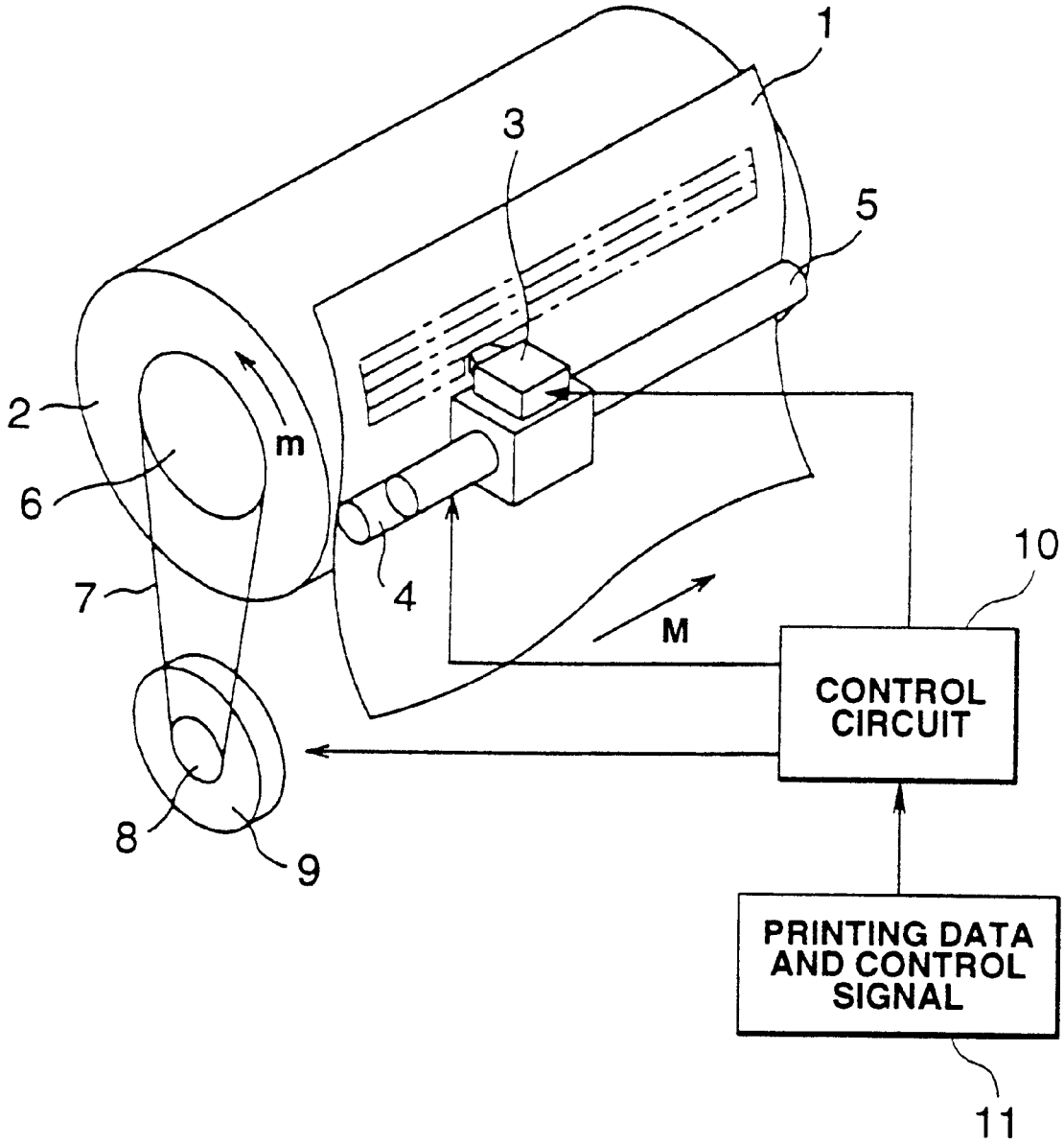
FIG. 1 is a schematic perspective view showing an essential portion of a printer according to an embodiment of the present invention.

FIG. 1 shows a printer according to the present invention which is a so-called serial type printer mainly consisting of a drum 2 on which a printing paper 1 is mounted and a printing head section 3 for carrying out a recording on the printing paper 1. The printing paper 1 is pushed and kept onto the drum 2 by a paper holding roller 4 provided in parallel to a shaft direction of the drum 2. The printer is also provided with a feed screw 5 in the vicinity of outer circumference of the drum 2 so as to be positioned in parallel to the shaft direction of the drum 2. The printing head 3 is mounted on this feed screw 5. That is, the printing head 3 is moved by rotation of the feed screw 5, in the shaft direction of the drum 2 as shown by an arrow "M" in the drawing.

The drum 2 is rotated via a pulley 6, a belt 7, and a pulley 8 by a motor 9 in the direction shown by an arrow "m" in the drawing. Rotations of the feed screw 5 and the motor 9 and the function of the printing head 3 are driven and controlled by a control circuit 10 for driving and feeding the head and controlling drum rotation according to a printing data and a control signal 11.

When the printing head has finished printing of one line while moving, the drum 2 is rotated by one line for printing of a following line. In a case when the printing head 3 moves for printing, the movement may be either one direction or reciprocal.

Figure 2:
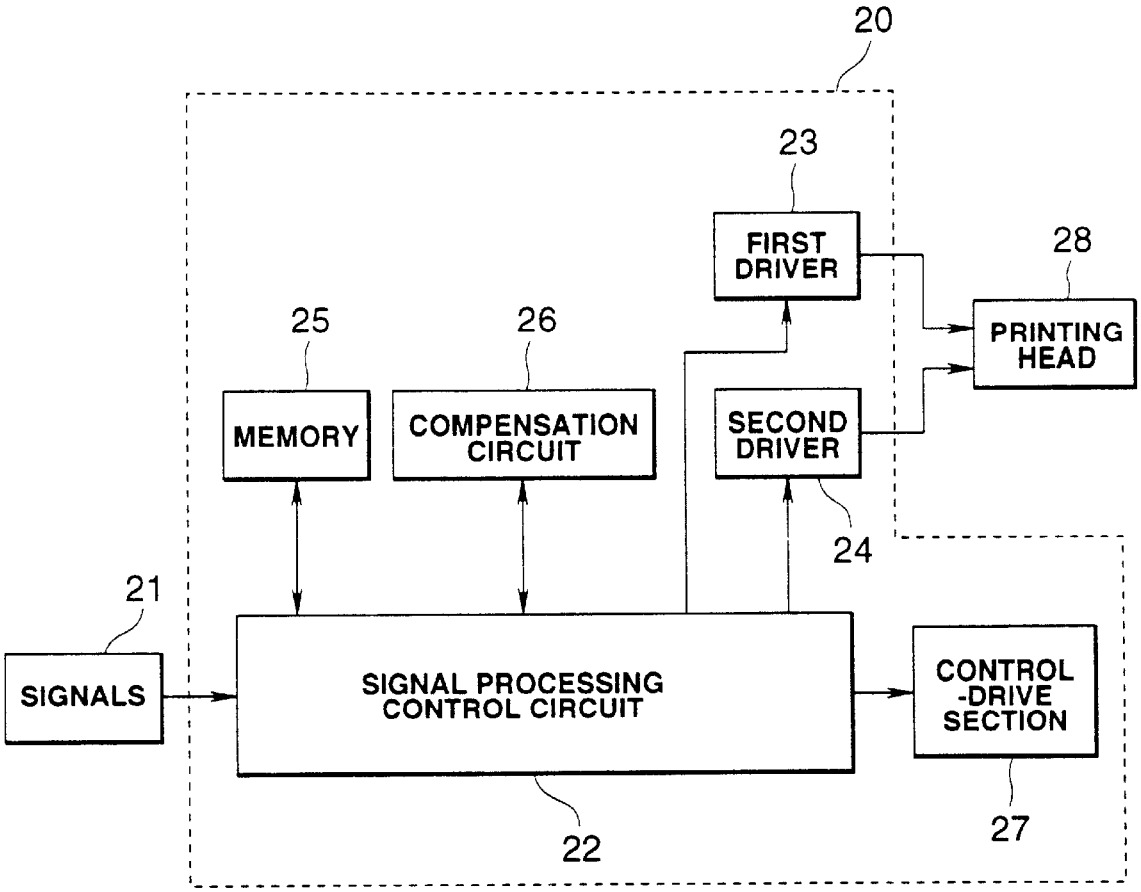
FIG. 2 is a block diagram of a printing and control system according to the embodiment of the present invention.

FIG. 2 is a block diagram showing a printing-control system of the printer. The printer is controlled by a control block 20 in FIG. 2 having a signal processing control circuit 22, a first driver 23, a second driver 24, a memory 25, a compensation circuit 26, and a control-drive section 27. The signal processing control circuit 22 is composed of a CPU or DSP (digital signal processor).

Each of the first driver 23 and the second driver 24 consists of a plurality of drivers according to a number of the quantitative medium nozzles and a number of the discharge medium nozzles, respectively. The first driver 23 is for driving-controlling a first layered piezoelectric device which is provided as first pressure means, as will be detailed later, for pushing the quantitative medium from the quantitative medium nozzle, whereas the second driver 24 is for driving-controlling a second layered piezoelectric device which is provided as second pressure means, as will be detailed later, for discharging the discharge medium from the discharge medium nozzle. Note that it is assumed that one of the quantitative medium and the discharge medium is ink, and the other is diluent.

The first driver 23 and the second driver 24 drive-control the first pressure means and the second pressure means, respectively, according to control by a serial-parallel conversion circuit and a timing control circuit which are provided in the signal processing control circuit 22.

The signal processing control circuit 22 of the control block 20 is supplied with a printing data and signals 21 such as an operation signal and an external control signal. The signal supplied are arranged in the printing order in this signal processing control circuit 22 and fed via the first driver 23 and the second driver 24 to the printing head 28 together with a discharge signal for driving-controlling the printing head 28. The printing order varies depending on the printing head 28 and the configuration of a printing section. The printing order also has a relationship with an input order of the printing data. A data may be stored in a memory 25 which is a line buffer memory, a one-screen memory or the like, and from which the data is fetched when necessary.

Note that when the printing head 28 is a multi-head type and has a plenty of nozzles, it is recommended to mount an IC on the printing head 28 so as to reduce the number of wires to be connected to the printing head 28. Moreover, the signal processing control circuit 22 is connected to the compensation circuit 26 for carrying out a y-correction and a color correction in case of a color printing as well as a correction required for compensating the characteristics difference of the heads. The compensation circuit 26 normally has a predetermined correction data stored in a form of a ROM (read only memory) as a look-up table, which data is fetched according to an external condition such as a nozzle number, temperature, and an input signal.

The signal processing control circuit 22 is normally composed of a CPU or DSP as has been described above, for software processing, and a signal which has been processed is supplied to the control-drive section 27. The control-drive section 27 carries out drive and synchronization of the motors for driving the drum 2 and the feed screw 5 and control a head cleaning, a printing paper supply and exhaust and the like. Note that the signals supplied from the signal processing control circuit 22 to the control-drive section 27 include an operation signal and an external control signal.

Figure 3:
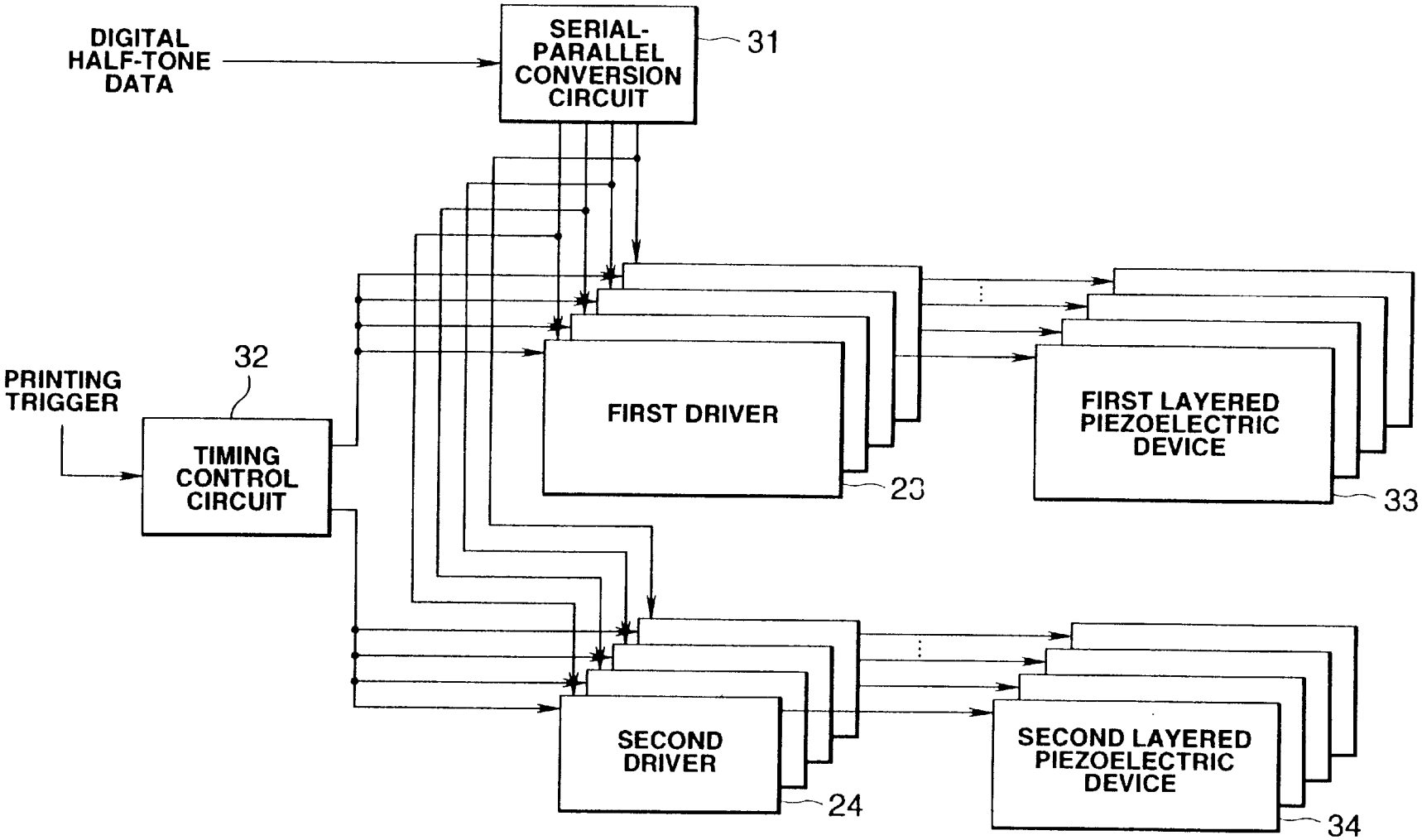
FIG. 3 is a block diagram of a drive circuit of the printing head according to the embodiment of the present invention.

FIG. 3 is a block diagram showing a drive circuit of the aforementioned printing head. The drive circuit is supplied with a digital half-tone data from the signal processing control circuit 22, which data is fed via the serial-parallel conversion circuit to the first driver 23 and the second driver 24. When the digital half-tone data supplied from the serial-parallel conversion circuit 31 is below a predetermined threshold value, no quantification is carried for discharging. When a printing timing has come, a printing trigger is outputted from the signal processing control circuit 22, which trigger is detected by the timing control circuit 32, which in turn outputs, at a predetermined timing, a quantification section control signal and a discharge control signal to the first driver 23 and to the second driver 24, respectively.

Figure 4:
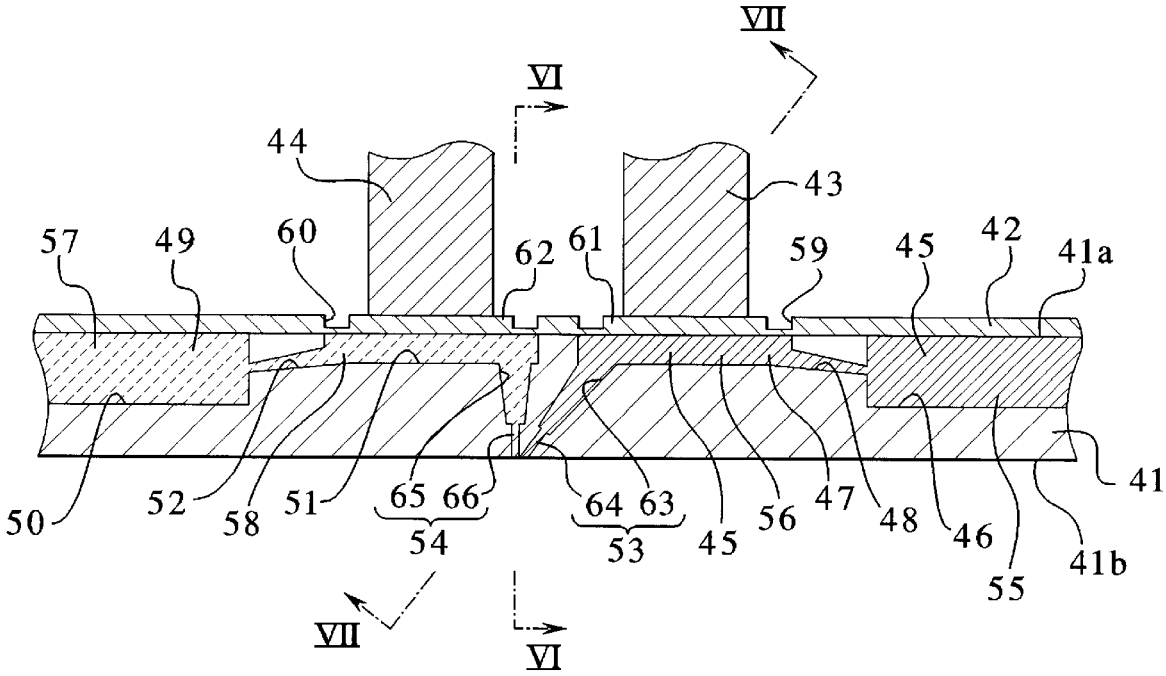
FIG. 4 is a schematic cross sectional view showing an essential portion of the printing head of the printer according to the embodiment of the present invention.

Description will now be directed to the printing head of the printer according to an embodiment of the present invention. As shown in FIG. 4, the printing head mainly consists of a nozzle plate 41, a diaphragm 42, a first layered piezoelectric device 43, and a second layered piezoelectric device 44.

The nozzle plate 41 is formed from a resin. The nozzle plate 41 is provided with a first recess 46 forming a quantitative medium port into which a quantitative medium 45 (ink, for example) is introduced; and a second recess 47 forming a quantitative medium pressure chamber which is filled with the aforementioned quantitative medium 45, both of the recesses opening to a main surface 41*a* of the diaphragm 42. A through hole is formed in the nozzle plate 41 so as to form a first supply passage 48 connecting the first recess 46 to the second recess 47.

Moreover, the nozzle plate 41 is provided with a third recess 50 forming a discharge medium port into which a discharge medium 59 (which is diluent, for example) and a fourth recess 51 forming a discharge medium pressure chamber filled with the discharge medium 49, both of the recesses opening to the main surface 41*a* of the diaphragm 42. A through hole is formed in the nozzle plate 41 so as to form a second supply passage 52 connecting the third recess 50 to the fourth recess 51.

Furthermore, the nozzle plate 41 is provided with a quantitative medium nozzle 53 formed as a through hole extending from the bottom of the second recess 47 to a rear surface 41*b* of the nozzle plate 41 at a predetermined angle against the direction of the thickness of the nozzle plate 41; and a discharge medium nozzle 54 formed as a through hole extending from the bottom of the fourth recess 51 to the rear surface 41*b* of the nozzle plate 41 in the direction of the thickness of the nozzle plate 41.

Figure 5:
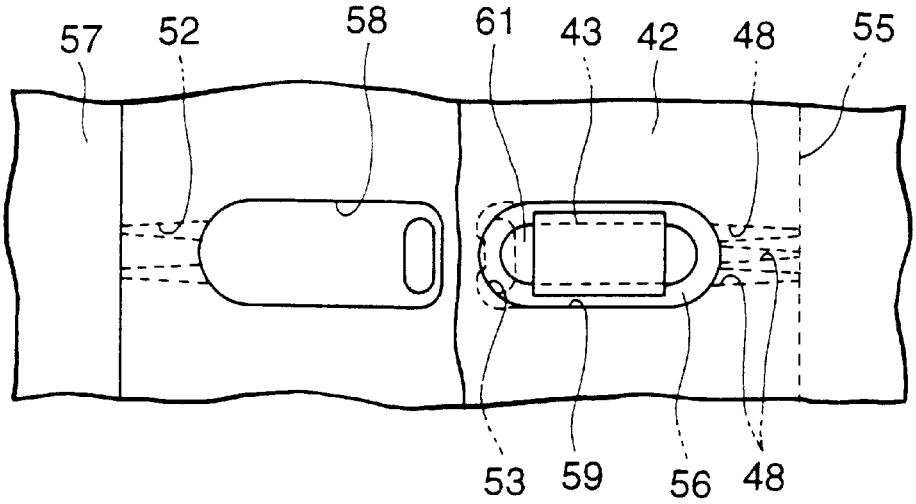
FIG. 5 is a schematic plan view of essential portion of the printing head of the printer according to the embodiment of the present invention.

The diaphragm 42 is provided on the main surface 41*a* of the nozzle plate 41 so as to cover the aforementioned recesses, so that a space defined by the first recess 46 and the diaphragm 42 serves as a quantitative medium port 55, and a space defined by the second recess 47 and the diaphragm 42 serves as a quantitative medium pressure chamber 56. As shown in FIG. 5, the quantitative medium port 55, the first supply passage 48, the quantitative medium pressure chamber 56 and the quantitative medium nozzle 53 are formed as a continuous unitary space.

Similarly, a space defined by the third recess 50 and the diaphragm 42 serves as the discharge medium port 57, and a space defined by the fourth recess 51 and the diaphragm 42 serves as a discharge medium pressure chamber 58. As shown in FIG. 5, the discharge medium port 57, the second supply passage 52, the discharge medium pressure chamber 58, and the discharge medium nozzle 54 are formed as a continuous unitary space.

FIG. 5 is a plan view of the first layered piezoelectric device 43 arranged on the quantitative side, and the main surface 41*a* of the nozzle plate 41 of the discharge side.

The diaphragm 42, as shown in FIG. 4, is provided with an annular recess 59 formed at a position corresponding to the quantitative medium pressure chamber 56, and an annular recess 60 at a position corresponding to the discharge medium pressure chamber 58. Consequently, when the diaphragm 42 is viewed from above, as shown in the quantitative side of FIG. 5, a protrusion 61 is formed at a position corresponding to the quantitative medium pressure chamber 56, on which the first layered piezoelectric device 43 is arranged. The discharge side has a similar configuration: as shown in FIG. 4, an annular recess 60 defines a protrusion 62, on which the second layered piezoelectric device 44 is arranged.

In the printing head according to the present embodiment, as has been described above, the quantitative medium nozzle 53 is formed at a predetermined angle against the direction of the thickness of the nozzle plate 41, whereas the discharge medium nozzle 54 is formed in the direction of the thickness of the nozzle plate 41 so that the quantitative medium nozzle 53 approaches the discharge medium nozzle 54 toward the rear surface 41*b* and these nozzles have openings adjacent to each other on the rear surface 41*b*. Note that the quantitative medium nozzle 53 has a center line at 300 to the center line of the discharge medium nozzle 54.

Figure 6:
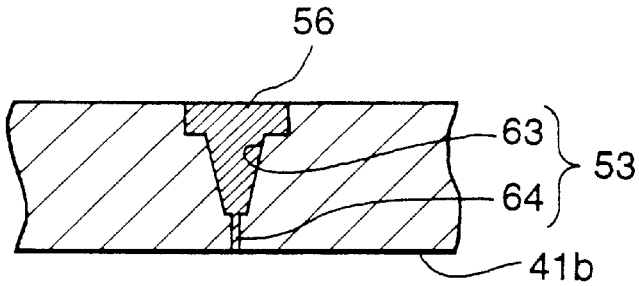
FIG. 6 is a schematic cross sectional view showing a portion in the vicinity of a quantitative medium nozzle of the printing head according to the embodiment of the present invention.

FIG. 6 is a cross sectional view of the quantitative medium nozzle 53 sectioned along the A–A' line in FIG. 4. As shown here, the quantitative medium nozzle 53 is divided into a first tapered nozzle portion 63 extending from the bottom of the quantitative medium pressure chamber 56 toward the rear surface 41*b* of the nozzle plate 41, reducing its cross sectional area; and a first nozzle portion 64 which actually functions as a nozzle.

Figure 7:
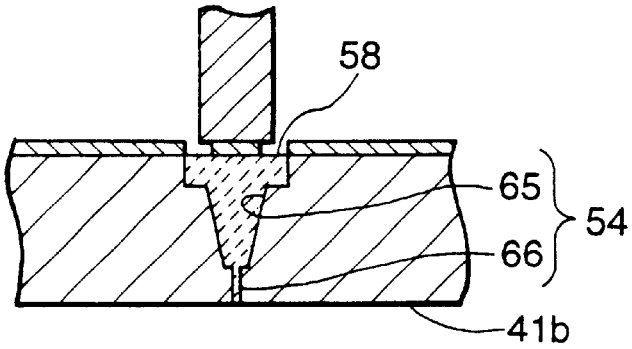
FIG. 7 is a schematic cross sectional view showing a portion in the vicinity of a discharge medium nozzle of the printing head according to the embodiment of the present invention.

FIG. 7 is a cross sectional view of the discharge medium nozzle 54 sectioned along the B–B' line in FIG. 4. As shown here, the discharge medium nozzle 54 is divided into a second tapered nozzle portion 65 extending from the bottom of the discharge medium pressure chamber 56 toward the rear surface 41*b* of the nozzle plate 41, reducing its cross sectional area; and a second nozzle portion 66 which actually functions as a nozzle.

The presence of the first tapered nozzle portion 63 and the second tapered nozzle portion 65 reduces the passage resistance in the quantitative medium nozzle 53 and in the discharge medium nozzle 54, so as to realize a smooth liquid flow, preventing residue of babbles The quantitative medium 45 which is, for example, ink is supplied from a quantitative medium reservoir (not depicted) through the quantitative medium port 55, the first supply passage 48, and the quantitative medium pressure chamber 56 to the quantitative medium nozzle 53.

The discharge medium 49 which is, for example, diluent is supplied from a discharge medium reservoir (not depicted) through the discharge medium port 57, the second supply passage 52, and the discharge medium pressure chamber 58 to the discharge medium nozzle 54.

In the printing head according to the present embodiment, the rear surface 41*b* of the nozzle plate 41 having the nozzle openings has a facility for liquid repellence so as not to be wetted by the ink or diluent from the quantitative medium nozzle 53 and the discharge medium nozzle 54, which enhances stability of the liquid discharge and the accuracy of the discharge direction.

Moreover, in the printing head according to the present embodiment, the opening of the quantitative medium nozzle 43 has a cut-off portion at the side of the discharge medium nozzle 54.

In other words, the quantitative medium nozzle 53 has an opening of such a shape that a center of a circumscribed circle 67 of the opening of the quantitative medium nozzle 53 is located at a position farther than the center of the inscribed circle of the opening of the quantitative medium nozzle 53 from the nearest point on the opening of the discharge medium nozzle 54.

Figure 8:
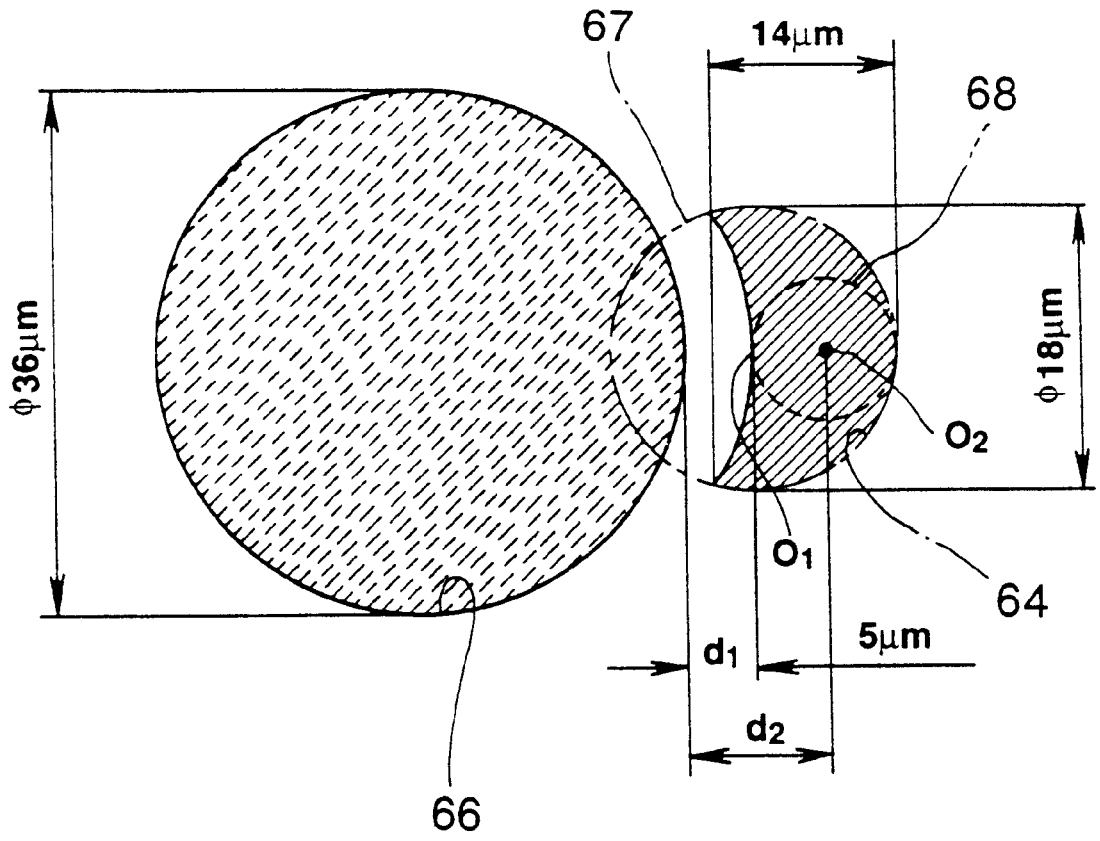
FIG. 8 is a schematic cross sectional view showing a portion in the vicinity of the quantitative medium nozzle and the discharge medium nozzle of the printing head according to the embodiment of the present invention.

FIG. 8 shows a circular opening of the second nozzle portion 66 of the discharge medium nozzle 54 and a crescent opening of the first nozzle portion 64 of the quantitative medium nozzle 53. In FIG. 8, if it is assumed that the opening of the first nozzle portion 64 of the quantitative medium nozzle 53 has a circumscribed circle 67 (dotted line) with a center $O_1$ and an inscribed circle 68 (broken line) with a center $O_2$, then the shortest distance $d_1$ from the center $O_1$ to the opening of the discharge medium nozzle 54 is smaller than the shortest distance $d_2$ from the center $O_2$ to the opening of the discharge medium nozzle 54.

In other words, in the printer according to the present embodiment, the quantitative medium nozzle 53 has an opening of such a shape that a center of a circumscribed circle 67 of the opening of the quantitative medium nozzle 53 is located at a position farther than the center of the inscribed circle of the opening of the quantitative medium nozzle 53 from the nearest point on the opening of the discharge medium nozzle 54.

Figure 9:
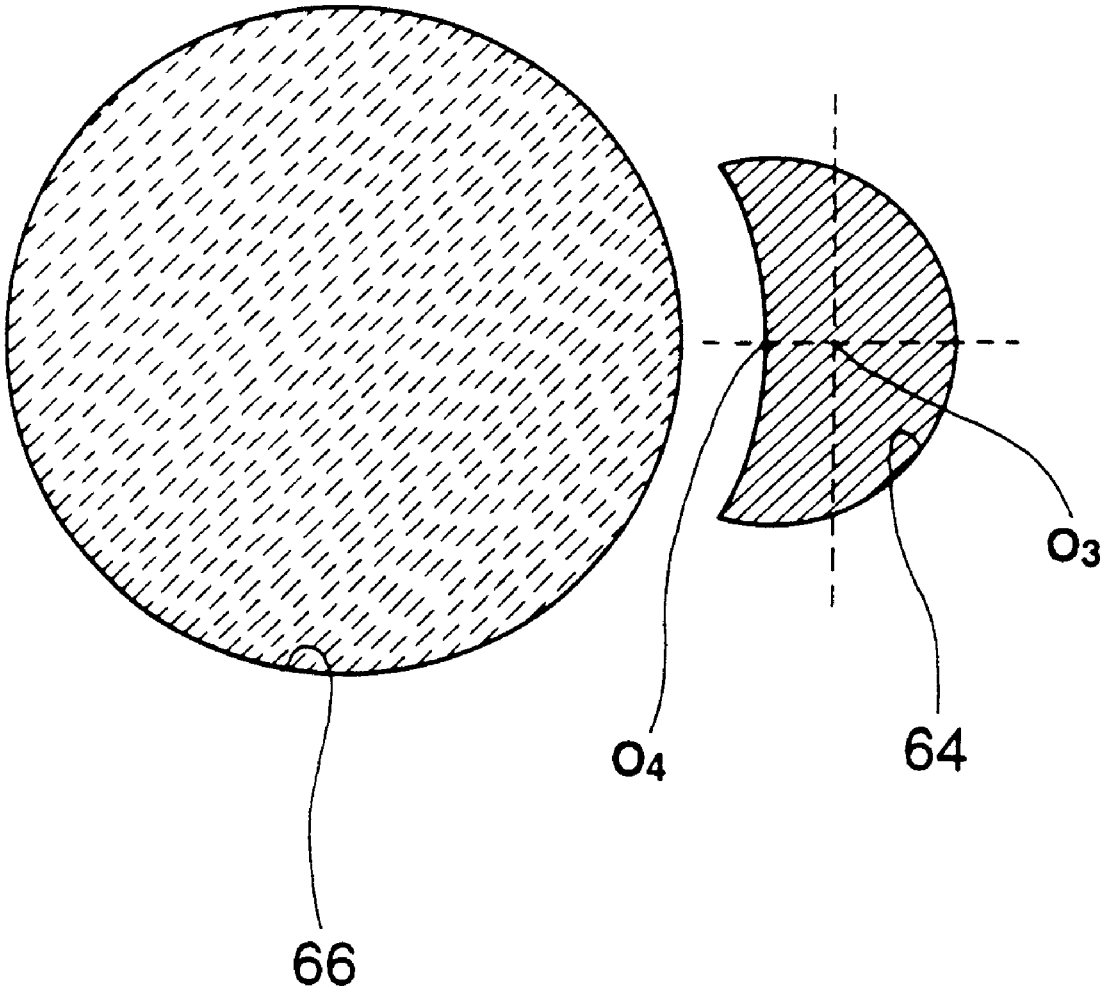
FIG. 9 is a schematic plan view showing a portion in the vicinity of the quantitative medium nozzle and the discharge medium nozzle of the printing head according to the embodiment of the present invention.

As shown in FIG. 9, the first nozzle portion 64 of the quantitative medium nozzle 53 has an opening of a crescent shape, which is positioned in such a manner that the nearest point $O_4$ on the opening end to the center $O_3$ of figure is facing to the opening of the second nozzle portion of the discharge medium nozzle 54.

It should be noted that there are 16 pairs of the quantitative medium nozzle 53 and the discharge medium nozzle 54 provided in the printer according to the present invention although only one pair is shown in the drawings. All of the quantitative medium nozzles 53 are arranged adjacent to one another and all of the discharge medium nozzles 54 are arranged adjacent to one another.

Description will now be directed to an printing operation using the printer according to the present embodiment, printing is carried out as follows. It should be noted that there are two types of layered piezoelectric devices: one which utilizes the a displacement of expanding direction (so-called $d_{33}$ direction) when a voltage is applied; and the other which utilizes a displacement of shrinking direction (so-called $d_{31}$ direction). It is assumed that the latter type of the layered piezoelectric device is employed in the present embodiment.

Figure 10:
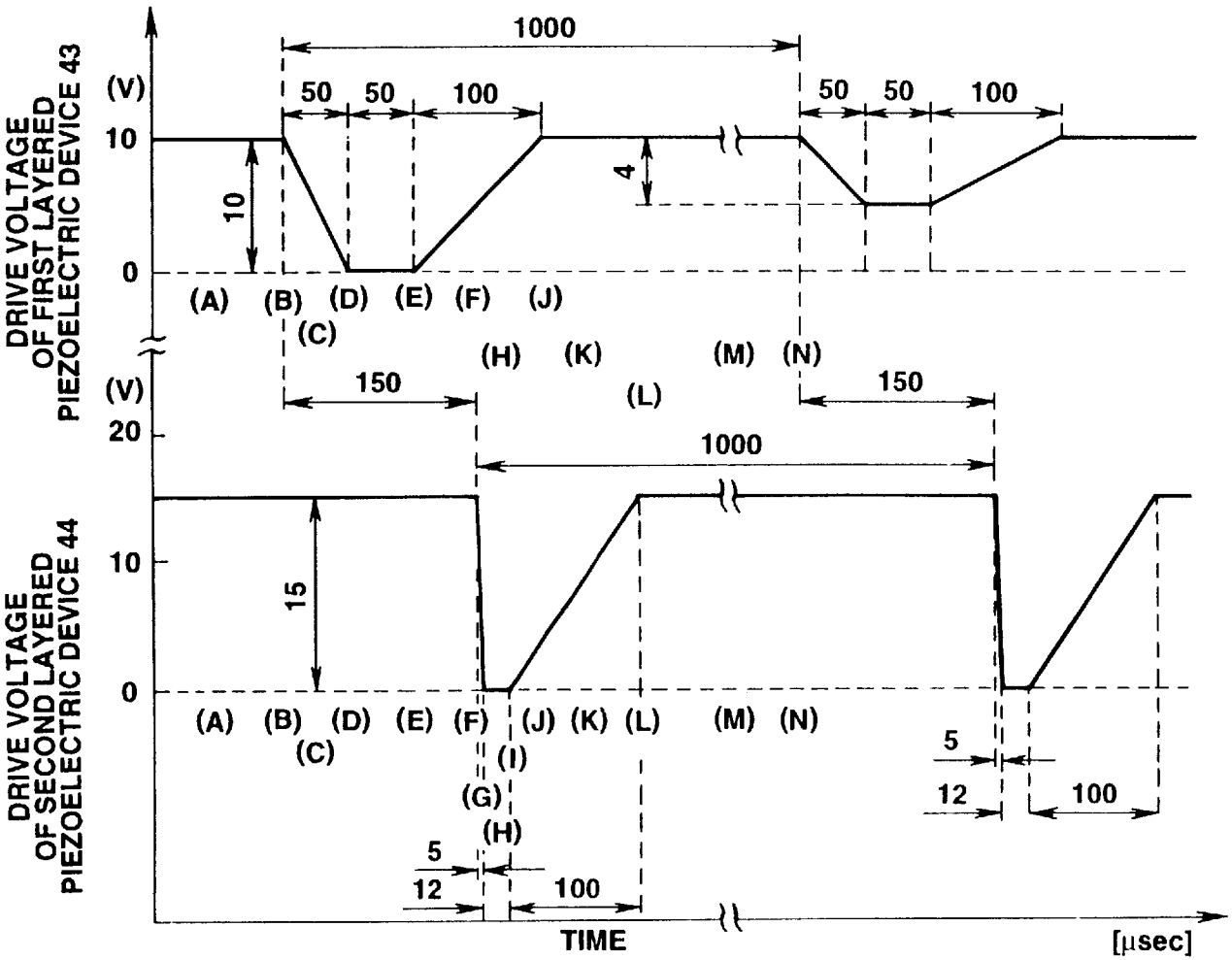
FIG. 10 is a chart showing the timing to apply a drive voltage to the printing head of the printer according to the embodiment of the present invention.

FIG. 10 is a timing chart which shows when a drive voltage is applied. In this timing chart, at a moment (A), a drive voltage of 10 [V] is applied to the first layered piezoelectric device 43 and a drive voltage of 15 [V] is applied to the second layered piezoelectric device 44. Note that in the timing chart of FIG. 10, the horizontal axis represents the time and the vertical axis represents the drive voltage of the first layered-type piezoelectric device 43 and the drive voltage of the second layered piezoelectric device 44.

Figure 11:
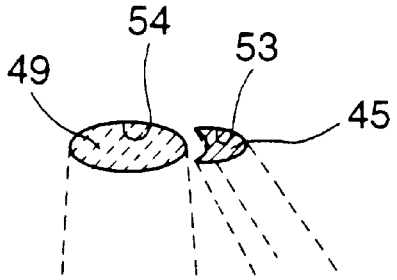
FIG. 11 is a schematic perspective view showing a wait state in a procedure for carrying out a printing using the printer according to the embodiment of the present invention.

At this moment, as schematically shown in FIG. 11, the quantitative medium nozzle 53 is filled with the quantitative medium 45 up to the opening end so as to form a meniscus. The discharge medium nozzle 54 is also filled with the discharge medium 49 up to the opening end so as to form a meniscus. Thus, the printing head enters a wait state. Note that at this moment of time, the first layered piezoelectric device 43 and the second layered piezoelectric device 44 are shrink, and those portions of the diaphragm which are in contact with these devices are pulled up so as to increase the volume of the quantitative medium pressure chamber 56 and the volume of the discharge medium pressure chamber 58. Because the quantitative medium nozzle 53 is provided separately from the discharge medium nozzle 54, the quantitative medium 45 will not be brought into contact to be mixed with the discharge medium 49 in this wait state.

Figure 12:
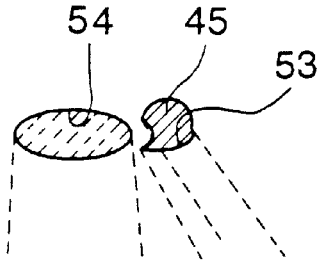
FIG. 12 is a schematic perspective view showing a state when a portion of the quantitative medium is pushed out in a procedure for carrying out a printing using the printer according to the embodiment of the present invention.

Next, at a moment (B) in FIG. 10, the drive voltage applied to the first layered piezoelectric device 43 begins to be decreased. This voltage is decreased down to 0 [V] for 50 [μsec] to a moment (D) in the chart. Then, the first layered piezoelectric device 43 expands so as to push the portion of the diaphragm 42 which is in contact with this first layered piezoelectric device 43, reducing the volume of the quantitative medium pressure chamber 56. For this, at an intermittent point (C) between (B) and (D) in FIG. 10, the quantitative medium 45 is pushed out of the quantitative medium nozzle 53 as shown in FIG. 12. Because the quantitative medium nozzle 53 is formed so as to gradually approach to the discharge medium nozzle 54, the quantitative medium 45 is pushed toward the discharge medium nozzle 54.

Figure 13:
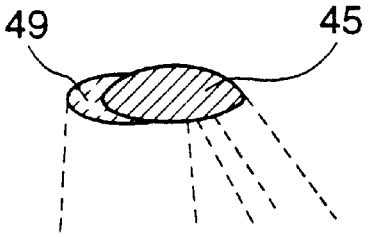
FIG. 13 is a schematic perspective view showing a state when the portion of the quantitative medium is brought into contact with the discharge medium in a procedure for carrying out a printing using the printer according to the embodiment of the present invention.

This state is kept for 50 [μsec] from the moment (D) to a moment (E) in the chart of FIG. 10. Then, as shown in FIG. 13, the quantitative medium 45 is brought into contact with the discharge medium 49 and they are connected to each other with a surface tension.

Subsequently, from the moment (E), the drive voltage to the first layered piezoelectric device 43 is gradually increased to the previous value so that the first layered piezoelectric device 43 shrinks again, increasing the volume of the quantitative medium pressure chamber 56 so that the quantitative medium 45 is drawn into the quantitative nozzle 53.

Figure 14:
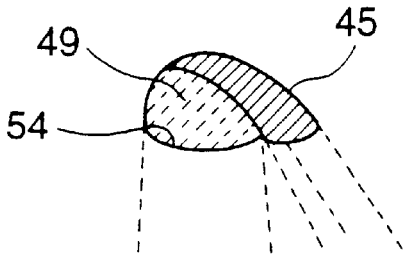
FIG. 14 is a schematic perspective view showing a state when the quantitative medium and the discharge medium are pushed outward in a procedure for carrying out a printing using the printer according to the embodiment of the present invention.

Next, the drive voltage is decreased from 15 [V] to 0 [V] for 5 [μsec] from a moment (F) after (E) to a moment (G) in the chart of FIG. 10, so that the second layered piezoelectric device 44 expands so as to push the diaphragm 42 which is in contact with this second layered piezoelectric device 44, reducing the volume of the discharge medium pressure chamber 58. As a result, at the moment (F), as schematically shown in FIG. 14, the discharge medium 49 is pushed outward from the discharge medium nozzle 54 and a portion of the quantitative medium which is in contact with the discharge medium 49 is also pushed outward.

Figure 15:
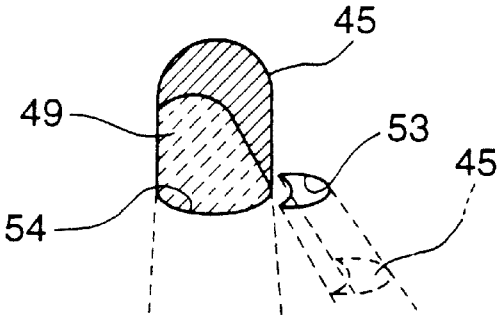
FIG. 15 is a schematic perspective view showing a state when the quantitative medium and the discharge medium are further pushed outward in a procedure for carrying out a printing using the printer according to the embodiment of the present invention.

This state is kept for 12 [μsec] from a moment (G) to a moment (I) in the chart of FIG. 10. At an intermittent moment (H) between the moments (G) and (I), as shown in FIG. 15, the discharge medium 49 is further pushed outward from the discharge medium nozzle 54 together with the quantitative medium 45.

At this moment, while the drive voltage to the first layered piezoelectric device 43 continues to increase, the quantitative medium 45 is drawn into the quantitative medium nozzle 53, leaving the portion outside which is in contact with the discharge medium 49.

Figure 16:
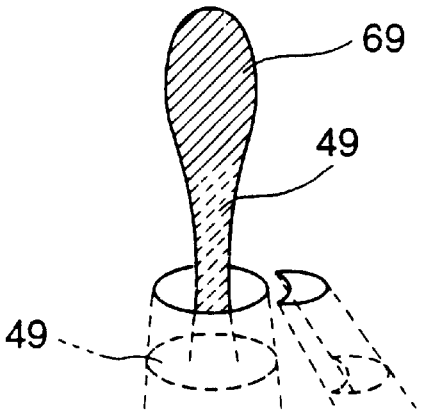
FIG. 16 is a schematic perspective view showing a state when a droplet of the liquid mixture is almost formed separating from the discharge medium in a procedure for carrying out a printing using the printer according to the embodiment of the present invention.

Next, from the moment (I) in the chart of FIG. 10, the drive voltage to the second layered piezoelectric device 44 is gradually increased so that the second layered piezoelectric device 44 again begins to shrink, increasing the volume of the discharge medium pressure chamber 58. As a result, at a moment (J) after the moment (I), as schematically shown in FIG. 16, a liquid mixture 69 of the quantitative medium and the discharge medium is almost separated as a droplet from the discharge medium 49. Note that at this moment, the drive voltage to the first layered piezoelectric device 43 is returned to the previous 10 [V], which is kept after this.

Figure 17:
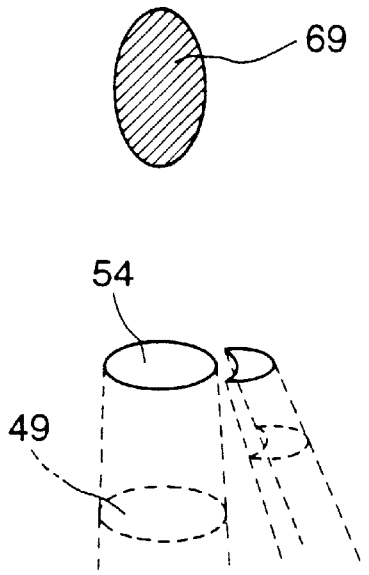
FIG. 17 is a schematic perspective view showing a state when the droplet of the liquid mixture is separated from the discharge medium in a procedure for carrying out a printing using the printer according to the embodiment of the present invention.

At a moment (K) after the moment (J) in the chart of FIG. 10, as schematically shown in FIG. 17, the liquid mixture 69 as a droplet is completely separated from the discharge medium 49 and discharged from the discharge medium nozzle 54 while the discharge medium 49 is pulled into the discharge medium nozzle 54.

Figure 18:
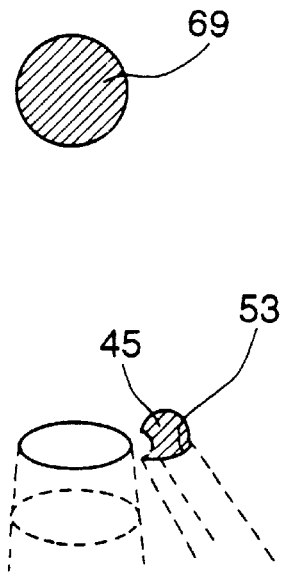
FIG. 18 is a schematic perspective view showing a state when the droplet of the liquid mixture continues flying in a procedure for carrying out a printing using the printer according to the embodiment of the present invention.

Furthermore, at a moment (L) after the moment (K) in the chart of FIG. 10, the drive voltage to the second layered piezoelectric device 44 is returned to the previous 15 [V]. Note that a period of time from the moment (I) to the moment (K) in the chart of FIG. 10 is 100 [μsec]. During this period, as schematically shown in FIG. 18, the droplet of the liquid mixture 69 in a ball shape continues flying toward a recording material. When the ball of the liquid mixture 69 has reached the recording material, a recording is complete.

It should be noted that during a period of time from the moment (J) to the moment (L) in the chart of FIG. 10, the quantitative medium 45 is gradually introduced into the quantitative medium nozzle 53 by the capillary tube force. At the moment (L), as schematically shown in FIG. 18, the quantitative medium nozzle 53 is filled with the quantitative medium 45 up to the opening end. In this state, the tip end of the quantitative medium 45 slightly vibrates, forming a small protrusion.

Figure 19:
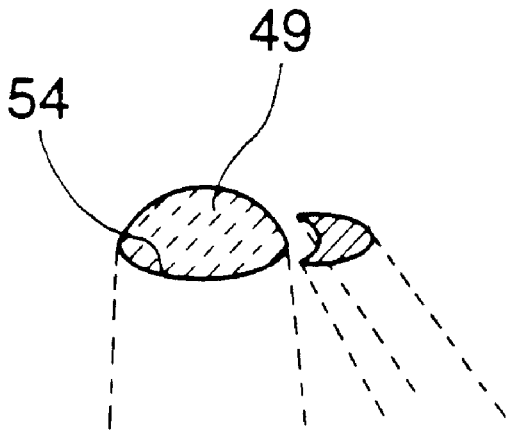
FIG. 19 is a schematic perspective view showing a state when a tip end of the discharge medium is above the opening of the discharge nozzle in a procedure for carrying out a printing using the printer according to the embodiment of the present invention.

At a moment (M) after the moment (L) in the chart of FIG. 10, as shown in FIG. 19, the discharge medium 49 is introduced into the discharge medium nozzle 54 by the capillary tube force in the same way as the quantitative medium 445. The tip end of the discharge medium 49 is slightly vibrated by an inertia, forming a small protrusion. At this moment, the quantitative medium 45 has ceased to vibrate.

Figure 20:
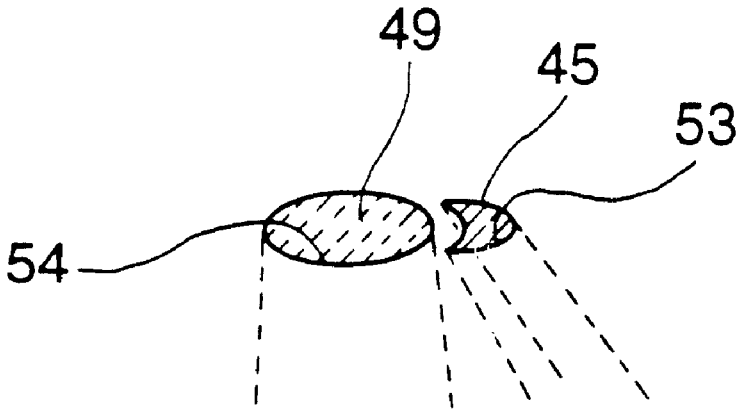
FIG. 20 is a schematic perspective view showing a wait state when the printer has again entered the wait state in a procedure for carrying out a printing using the printer according to the embodiment of the present invention.

Furthermore, at a moment (N) after the moment (M) in the chart of FIG. 10, as schematically shown in FIG. 20, the discharge medium 49 also has ceased to vibrate. The wait state is again set in.

In this embodiment, a discharge cycle is assumed to be 1 [m sec] (frequency 1 [kHz]), during which the quantitative medium is mixed with the discharge medium and the obtained mixture is discharged. It is also assumed that the maximum drive voltage for the first layered piezoelectric device 43 is 10 [V], whereas the maximum drive voltage for the second layered piezoelectric device 44 is 15 [V].

For carrying out a printing, the aforementioned cycle is repeated. In order to express a concentration gradation, it is necessary to change the ink concentration for each of the dots. In the present embodiment, as shown in FIG. 10, the concentration is adjusted by changing the drive pulse amplitude (voltage) of the first layered piezoelectric 43. For example, if the voltage is reduced from 10 [V] to 4 [V], the quantity of the ink to be quantified is reduced. Note that a similar effect can also be obtained by changing a width of the drive pulse.

In the printer according to the present embodiment, the quantitative medium nozzle 52 for pushing out the quantitative medium 45 is provided separately from the discharge medium nozzle 54 for discharging the discharge medium 49. Consequently, during a wait state, the quantitative medium 45 will not be brought into contact with the discharge medium 49, assuring separation therebetween. Moreover, during a mixture discharge operation, no unnecessary flow-in occurs between the quantitative medium 45 and the discharge medium 49 into the wrong nozzles.

Furthermore, the printer according to the present invention has the quantitative medium nozzle 54 provided adjacent to the discharge medium nozzle 54, enabling to stabilize supply, i.e., seeping-out of the quantitative medium 45 from the quantitative medium nozzle 53 toward the discharge medium nozzle 54.

Moreover, in the printer according to the present invention, the quantitative medium nozzle 53 has an opening of such a shape that a center of a circumscribed circle of the opening of the quantitative medium nozzle 53 is located at a position farther than the center of the inscribed circle of the opening of the quantitative medium nozzle 53 from the nearest point on the opening of the discharge medium nozzle 54. In other words, the opening of the quantitative nozzle 53 is positioned in such a manner that the nearest point on the opening end to the center of figure faces to the opening of the second nozzle portion of the discharge medium nozzle 54.

That is, the quantitative nozzle 53 has an opening with a cut-off facing the discharge medium nozzle 54. Consequently, the discharge medium 45 is secured to be pushed toward the discharge medium nozzle 54.

More concretely, in the printer according to the present embodiment, the quantitative medium nozzle 53 has an opening of a crescent shape and accordingly, the quantitative medium 45 is surely pushed toward the discharge medium nozzle 54.

Thus, in the printer according to the present embodiment, it is possible to prevent dispersion and mixture of the quantitative medium and the discharge medium during a wait state and to prepare an accurate mixture of the quantitative medium and the discharge medium according to a gradation step, enabling to express an accurate gradation step.

Figure 21A:
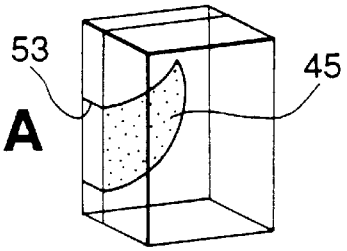
FIG. 21 schematically shows the behavior of the quantitative medium when carrying out a printing using the printer according to the embodiment of the present invention.

In order to confirm the effect of the printer according to the present invention, a computer simulation was carried out to watch how the quantitative medium 45 is pushed out of the opening of the quantitative medium nozzle 53 having a crescent shape. FIG. 21A shows the quantitative medium 45 which is introduced into the quantitative medium nozzle 53. Note that FIG. 21 shows a half portion of the crescent shape of the opening of the quantitative medium nozzle 53 and only the surface of the quantitative medium 45 is shown. It is assumed that the discharge medium nozzle 54 is located above this half crescent in this figure. Moreover, it is assumed here that the quantitative medium nozzle 53 is formed in the direction of the thickness of the nozzle plate.

Figure 21B:
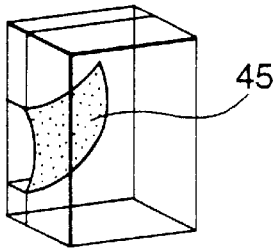
Figure 21C:
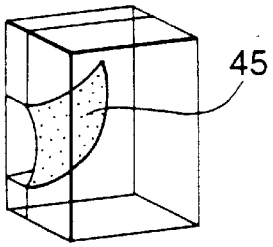
Figure 21D:
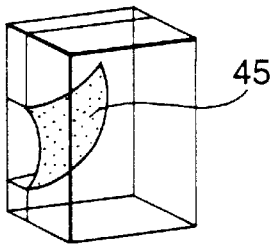
Figure 21E:
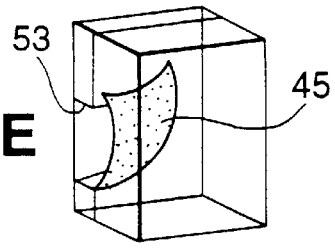
Figure 21F:
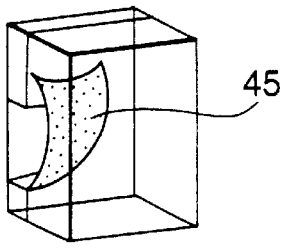

When the drive voltage of the first layered piezoelectric device 43 begins lowering, the surface of the quantitative medium 45 is gradually raised as shown in FIG. 21B, 21C, and 21D. Then, as shown in FIG. 21E, the quantitative medium 45 is pushed out toward the discharge medium nozzle 54, extending toward the discharge medium nozzle 54 as shown in FIG. 21F and 21G.

Figure 21G:
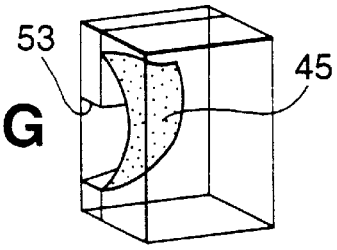

Because the opening of the quantitative medium nozzle 53 has a crescent shape, as show in FIG. 21G, the quantitative medium is pushed out from the quantitative medium nozzle 53, gathering around the center of the recessed side. Furthermore, because the discharge nozzle 54 has an opening facing the recessed side of the crescent shape, the quantitative medium 45 is secured to be brought into contact with the discharge medium 49 in the discharge medium nozzle 54.

That is, in the aforementioned printer, accurate quantification of the quantitative medium is carried out, enabling to mix an accurate quantity of the quantitative medium with the discharge medium according to a gradation step and to express the gradation step accurately.

A sufficient effect can be obtained even in this simulation where the quantitative medium nozzle 53 is formed in the direction of the thickness of the nozzle plate. In a case when the quantitative nozzle 53 is formed with an angle against the direction of the thickness of the nozzle plate, even more effect can be expected because the quantitative medium 45 is directed toward the discharge medium by the quantitative medium nozzle 53.

As ink and diluent which are the quantitative medium 45 and the discharge medium 49, respectively, in this embodiment, there can be exemplified following materials.

The ink may be as follows:

<Composition>

C. I. Acid Blue-9 . . . 8% by weight

N-methyl-2-pyrolidone . . . 10% by weight

Ethylene glycol monomethyl ether . . . 10% by weight

Surface active agent . . . 0.01% by weight

Water . . . 81.99% by weight

<Material Characteristics>

Viscosity . . . 2 [cp]

Surface tension . . . 30 [dyne/cm] (at 20° C.)

The diluent may be as follows:

<Composition>

Isopropyl alcohol . . . 7% by weight

Diethylene glycol . . . 23% by weight

Water . . . 70% by weight

<Material Characteristics>

Viscosity . . . 2.2 [cp]

Surface tension . . . 40 [dyne/cm] (at 20° C.)

The above example uses the cyan color. Other colors can also be used. The recording material may be a standard paper or an ink-jet printing paper available in market.

The size of the opening of the quantitative medium nozzle 53 and the size of the opening of the discharge medium nozzle 54 should be determined, considering the volume of the quantitative medium to be quantified and the volume of a liquid mixture to be discharged. For example, as shown in FIG. 8, it is preferable that the second nozzle portion 66 serving as the opening of the discharge medium nozzle 54 have a circular shape with a diameter of 36 [μm]; the first nozzle portion 64 serving as the opening of the quantitative medium nozzle 53 have a crescent form, i.e., a circle with a diameter of 18 [μm] having such a recess facing the second nozzle portion 66 that a distance from the recess end to the bottom is 14 [μm]. and the shortest distance from the opening end of the second nozzle portion 66 to the center of the recess is 5 [μm]. The distance between the quantitative medium nozzle 53 and the discharge medium nozzle 54 is preferably 20 [μm] or below, and more preferably 10 [μm] or below, and further preferably in the order of 5 [μm].

If this distance is too great, it is necessary to increase the drive voltage of the first layered piezoelectric device 43 so that the quantitative medium 45 reaches the discharge medium nozzle 54. If this drive voltage is too high, the quantitative medium 45 is discharged from the quantitative medium nozzle 53, instead of being pushed toward the discharge medium nozzle 54, failing to be mixed with the discharge medium 57.

As the quantitative medium pressure chamber 56 and the discharge medium pressure chamber 58, there can be exemplified a chamber having an elliptical shape, when viewed from above, with a width of 0.4 [mm] and a length of 0.9 [mm], and a depth of 0.1[mm]. As the diaphragm, there can be exemplified a diaphragm having a thickness of 60 μm along the entire length and about 6 mm where the recesses 59 and 60 are formed.

In the aforementioned printer according to the present embodiment, layered piezoelectric devices are used as pressure generating means. However, it is also possible to use a so-called single-plate piezoelectric device or other pressure generating means such as a heater element and a magnetic distortion element. Moreover, it is also possible to employ different types of pressure generating means for the quantitative section and the discharge section.

Description will now be directed to a manufacturing method of the printing head of the aforementioned printer. Firstly, it is necessary to prepare a nozzle plate from a resin plate having a uniform thickness and preferable surfaces. The resin material may be polysulfone, polyethersulfone, polyetherimide, polyimide or the like which can be subjected to a processing using eximer laser and exhibit an ink resistance (chemical resistance). The present embodiment employs a polyimide plate of 0.5 [mm] thickness which has been prepared by injection molding. It is also possible to prepare such a resin plate of 0.5 [mm] thickness by means of extrusion molding.

Subsequently, the mains surface, i .e., the main nozzle opening surface of the resin plate is subjected to a treatment for liquid repellence. That is, the surface is spin-coated with a liquid-repellent agent. As the liquid-repellent agent, it is preferable to employ one which is polymerized by a heat of 180 [°C.] or below because of the heat resistance, such as Saitop (trade name) produced by Asahi Glass Co. , Ltd. and Upicoat (trade name) produced by Ube Kosan Co., Ltd.

The aforementioned water repellence can also be obtained by laminating the resin plate with a liquid repellent film. As such a liquid repellent film, there can be exemplified a polyimide adhesive film UPA-8322 (trade name) produced by Ube Kosan. The aforementioned film can be applied at the maximum temperature up to 160 [°C.] so as to form a liquid-repellent having an excellent chemical resistance.

Next, the nozzle plate is subjected to a machine processing so as to determine the external configuration as well as the first recess and the second recess serving as the quantitative medium port and the discharge medium port, respectively. Burrs can be removed by lapping or the like.

Subsequently, processing using eximer laser is carried out to form the second recess and the fourth recess serving as the quantitative medium pressure chamber and the discharge medium pressure chamber, respectively. The aforementioned eximer laser processing is a method using a so-called mask imaging method, in which a mask (a metal plate for forming the recesses) is placed in the way of the laser optical system for ablation processing of the resin plate.

The mask can be prepared by etching a copper or stainless plate or electroforming a nickel material. The mask hole size is determined according to a hole or groove to be formed and the reduction ratio of the eximer laser optical system.

The second recess and the fourth recess can be formed simultaneously or successively. In a case of a multi-head configuration in which a plurality of sets of the first pressure chamber and the second pressure chamber are arranged, the plurality of sets may be formed simultaneously. For processing, the workpiece is placed on a processing table (fixed by an appropriate jig) capable of numeric control. The processing position is adjusted by position control (x-axis and y-axis control) in horizontal directions, whereas the laser focusing during a processing is adjusted in a vertical direction (z axis).

Next, a second tapered nozzle portion serving as the discharge medium nozzle is prepared by using eximer laser processing. A laser beam is applied through a round hole mask while oscillating a processing stage so as to gradually reduce the width of the oscillation, thus obtaining a tapered hole. In the present embodiment, one axis of the processing stage is controlled so as to obtain a taper of a sector shape. However, it is also possible to control two axes simultaneously so as to move the processing stage in a spiral state, obtaining a taper of a circular cone shape.

After this, the second nozzle portion is formed so as to serve as the discharge medium nozzle. Because of the eximer laser processing characteristic, a taper of about 2° (at one side) is formed in this second nozzle portion. The same applies to the processing for forming other holes and grooves.

The mask has holes corresponding to the respective recesses, the second taped nozzle portion and the second nozzle portion, so that a desired hole is set in the optical path of the laser beam by a mask changer capable of numeric control.

In the same way as the second tapered nozzle portion, the first tapered nozzle portion serving the quantitative medium nozzle is formed by slanting the workpiece fixing jig on the processing table by 30°.

Furthermore, the first nozzle portion is formed so as to serve as the quantitative medium nozzle. This first nozzle portion, as has been described above, has a cross section of a crescent shape. This crescent shape can easily be obtained by preparing a crescent shape of a hole in the mask. Other than this crescent shape, the first nozzle portion serving as the quantitative medium nozzle can be formed in various shapes. When using eximer laser processing, such shapes of the first nozzle portion (orifice) can easily be obtained by preparing such shapes in the mask.

The relative positioning of the second nozzle portion of the discharge nozzle and the first nozzle portion of the quantitative medium nozzle is adjusted by adjusting the processing stage in jog mode when forming the quantitative medium nozzle.

Next, the workpiece fixing jib is slanted by 80° for forming the second supply passage; and further slanted −80° (i.e., 80° in the opposite direction) for forming the first supply passage, thus completing the nozzle plate.

Each of the first supply passage and the second supply passage is a round hole. The size and number of the first supply passages are determined considering the flow resistance balance between the first tapered nozzle portion and the first nozzle portion, whereas the size and number of the second passages are determined considering the flow resistance balance between the second tapered nozzle portion and the second nozzle portion.

In this embodiment, a machine processing was employed for forming the external configuration of the nozzle plate and the recesses serving as the quantitative medium port and the discharge medium port; and eximer laser processing for forming all of the recesses serving as the quantitative medium pressure chamber and the discharge medium pressure chamber, the tapered nozzle portions, the nozzle portions, and the supply passages. However, it is also possible to employ an injection molding for forming the external configuration, the recesses serving as the quantitative medium port and the discharge medium port, and the tapered nozzle portions; and to employ the eximer laser processing for forming the nozzle portions and the supply passages.

Next, the diaphragm which has been prepared by means of etching, electroforming or the like is attached to the aforementioned nozzle plate thus prepared. The adhesive agent is preferably an epoxy adhesive. In this embodiment, a cold setting adhesive of single-liquid type is employed. The adhesive is applied onto a plate or sheet having a predetermined surface roughness and smoothed by a squeezer. The nozzle plate is pushed against this smoothed adhesive so that the adhesive is transferred in a small thickness. In this state, the diaphragm is attached to the nozzle plate by adjusting the position using the jig. The nozzle plate with the attached diaphragm is kept in an oven at a predetermined temperature for a predetermined period of time for the adhesive setting. As a result, the first recess, the second recess, the third recess, and the fourth recess are covered so as to define the quantitative medium port, the quantitative medium pressure chamber, the discharge medium port, and the discharge medium pressure chamber.

Prior to this adhesion step, it is also possible to apply a ultraviolet radiation to the nozzle plate so as to change the property of the resin surface. The light source of the ultraviolet ration is a low pressure mercury lamp which generates an ultraviolet beam of 184.9 [nm] and 253.7 [nm]. This energy cuts connections between molecules of a high molecule compound so as to extract hydrogen, which i9s connected with oxygen in the air so that radicals such as —OH, >C═O, and —C(O)OH are formed, enhancing the hydrophilic property of the surface of the nozzle plat, which in turn improves the adhesion property. This prevents peeling-off of the diaphragm after using the printing head for a long period of time.

Furthermore, the drive section including the layered piezoelectric device is bonded. The drive section includes a quantitative medium supply reservoir and a diluent supply section from which the quantitative medium and the diluent are supplied through holes formed in the diaphragm into the quantitative medium port and the diluent port. The quantitative medium supply section and the diluent supply section communicate with the quantitative medium reservoir and the diluent reservoir, respectively.

As the last step, the first layered piezoelectric device is bonded onto the protrusion of the diaphragm formed at a position corresponding to the quantitative medium pressure chamber, whereas the second layered piezoelectric device is bonded onto the protrusion of the diaphragm formed at a position corresponding to the discharge medium pressure chamber, thus completing the printing head.

In the aforementioned embodiment, the first nozzle portion of the quantitative medium nozzle has a cross section of a crescent shape. However, the shape may be other than the crescent if the first nozzle portion has an opening has such a shape that the distance between the center of the circumscribed circle of the opening and the nearest point on the opening of the discharge nozzle is smaller than the distance between the center of the inscribed circle of this opening and the nearest point on the opening of the discharge medium nozzle.

Alternatively, the first nozzle portion may have an opening of such a shape that the nearest point on the opening end from the center of figure of this opening faces the discharge medium nozzle 54.

Moreover, the first nozzle portion of the quantitative medium nozzle may have an opening of such a shape having a cut-off portion facing the discharge medium nozzle.

In this case, it is preferable that the shape of the opening of the first nozzle portion of the aforementioned quantitative medium nozzle be symmetric with respect to a line connecting the center of the opening of the discharge medium nozzle and the center of opening of the first nozzle portion with the cut-off portion restored.

It should be noted that the shape of the opening of the aforementioned first nozzle portion be a circle or polygon when the cut-off portion is restored.

The cut-off portion may have a circular arc or a corner.

FIG. 22 shows examples of such configurations. FIG. 22A shows a quantitative medium nozzle 70 with a circular opening with a cut-off portion having a corner facing the discharge medium nozzle 54. FIG. 22B shows a quantitative medium nozzle 71 with an octagonal opening having a cut-off portion of an arc shape facing the discharge medium nozzle 54. FIG. 22C shows a quantitative medium nozzle 72 with an elliptical opening having a cut-off portion of an arc shape facing the discharge medium nozzle 54. FIG. 22D shows a quantitative medium nozzle 73 with a circular opening having a diameter greater than the diameter of the discharge medium nozzle 54 and having a cut-off portion of an arc shape facing the discharge medium nozzle 54.

Figure 22A:
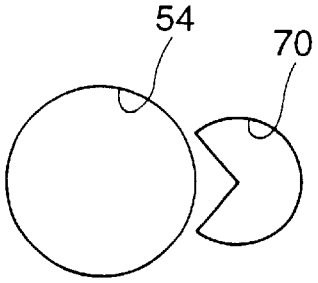
FIG. 22 is a schematic plan view showing the discharge medium nozzle and the quantitative medium nozzle of the printing head of the printer according to a modified embodiment of the present invention.
Figure 22B:
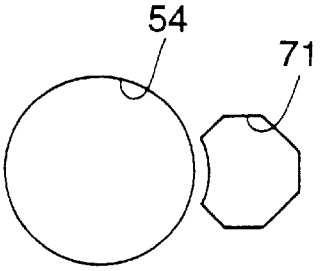
Figure 22C:
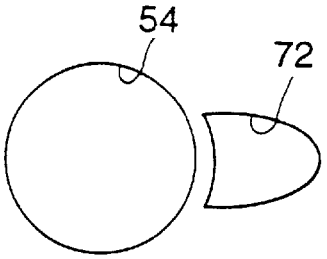
Figure 22D:
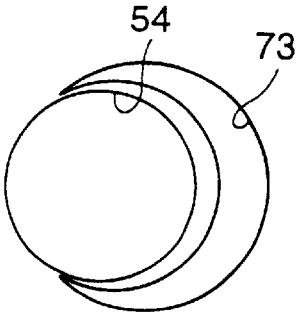
Figure 22E:
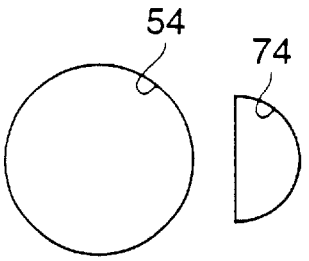
Figure 22F:
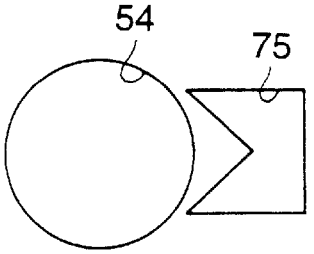
Figure 22G:
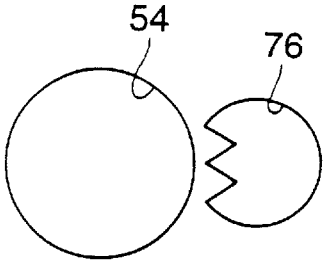

Furthermore, FIG. 22E shows a quantitative medium nozzle 74 with a semicircular opening having a direct portion to face the discharge medium nozzle 54. FIG. 22F shows a quantitative medium nozzle 75 having a rectangular opening with a V-shaped cut-off portion facing the discharge medium nozzle 54. FIG. 22G shows a quantitative medium nozzle 76 with a circular opening having a W-shaped cut-off portion facing the discharge medium nozzle 54.

In the printer using a quantitative medium nozzle with an opening of the aforementioned configurations wherein the cut-off portions face the discharge medium nozzle, the quantitative medium is sure to be pushed toward the discharge medium nozzle.

In the printer using a quantitative medium nozzle with an opening of the aforementioned configurations, the quantitative medium is further sure to be pushed toward the discharge nozzle because the discharge medium nozzle opening and the quantitative medium nozzle are arranged symmetrically with respect to a line connecting the center of the discharge medium nozzle opening and the center of the quantitative medium opening when the cut-off portion is restored.

Thus, a printer having a quantitative medium nozzle with an opening of the aforementioned configurations also enables to mix a discharge medium with an accurate quantity of a quantitative medium according to a gradation step, and to discharge the obtained mixture for accurately expressing the gradation step.

The discharge medium nozzle may have an opening of other than a circular shape such as a rectangular opening and a polygonal opening.

In the aforementioned printer, a single quantitative medium nozzle faces one discharge medium nozzle. However, it is also possible to arrange a plurality of quantitative medium nozzles so as to face one discharge medium nozzle.

Figure 23:
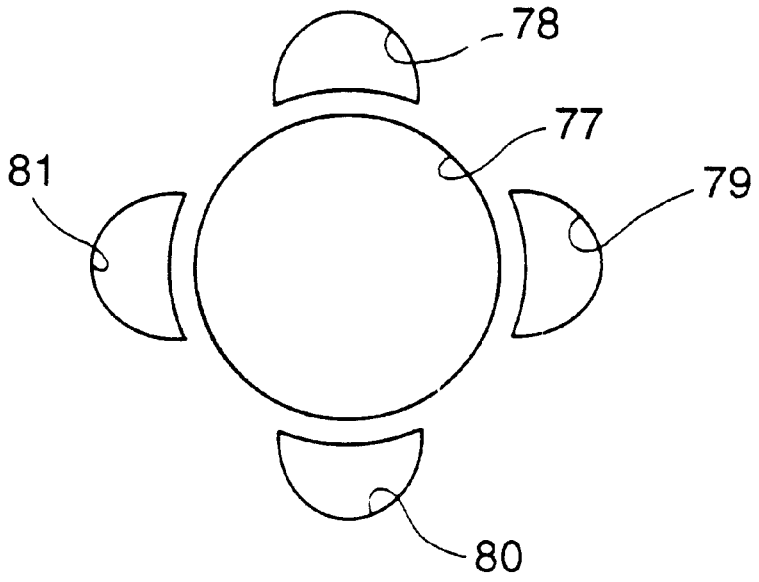
FIG. 23 is a schematic plan view showing the discharge medium nozzle and the quantitative medium nozzle of the printing head of the printer according to another modification of the embodiment of the present invention.

FIG. 23 shows a discharge medium nozzle 77 surrounded by four quantitative medium nozzles 78, 79, 80, and 81 each having a crescent shape. In such a case when a plurality of quantitative nozzles 78, 79, 80, and 81 are arranged for a single discharge medium nozzle, it is possible to simultaneously mix different colors for discharge. That is, a full color expression is enabled by a single droplet. In this case, the four quantitative medium nozzles are assumed to be used for Yellow, Cyan, Magenta, and Black.

Figure 24:
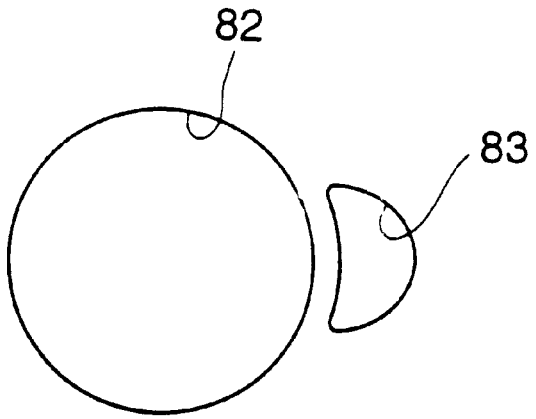
FIG. 24 is a schematic plan view showing the discharge medium nozzle and the quantitative medium nozzle of the printing head of the printer according to still another modification of the embodiment of the present invention.

In a case when the quantitative medium nozzle opening has a corner, a dye solved in the ink may be caught in the corner where the dye is dried and solidified. To cope with this, it is possible to make the corner round, as shown in FIG. 24, so as to prevent solidification of the dye in the corner.

Moreover, as shown in FIG. 25A and FIG. 25B, it is also possible to provide a groove portion 86 to connect a discharge medium nozzle 84 with a quantitative medium nozzle 85 having a crescent opening. This groove portion 86 serves as a guide from the quantitative medium nozzle 86 to the discharge medium nozzle 84 and the quantitative medium is further assured to be pushed toward the discharge medium nozzle.

In the aforementioned embodiment, the nozzle plate is subjected to a treatment for liquid repellence over an entire nozzle opening surface. However, it is also possible to carry out a non-liquid-repellence treatment or a hydrophilic treatment for a region between the discharge medium nozzle opening and the quantitative medium nozzle opening. That is, as shown in FIG. 26, it is possible to provide a non-liquid-repellent portion 89 connecting an opening of the quantitative medium nozzle 88 with an opening of the discharge medium nozzle 87. Because this non-liquid-repellent portion 89 easily gets wet, it serves as a guide for the quantitative medium to be further assured to be pushed toward the discharge medium nozzle.

Furthermore, instead of the non-liquid-repellent portion 89, it is possible to provide a hydrophilic portion, which further assures to push the quantitative medium toward the discharge medium nozzle.

Figure 27A:
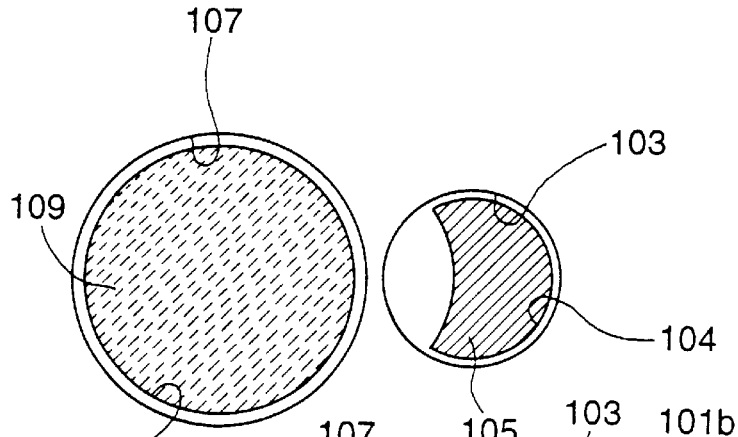
FIG. 27A is a plan view and FIG. 27B is a cross sectional view which schematically show the first nozzle and the second nozzle of the printing head according to a yet still further modification of the present invention.
Figure 27B:
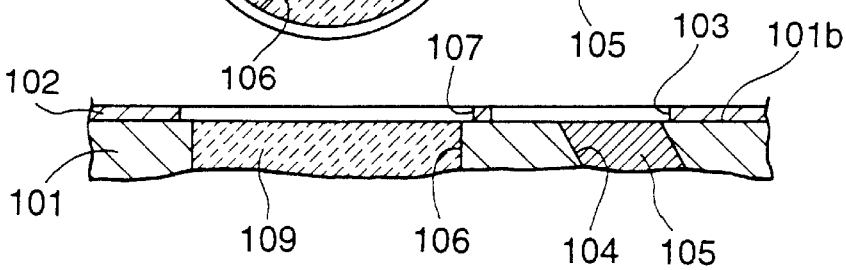

As a printer according to the present invention, there can be exemplified such that having a printing head as schematically shown in FIG. 27B. That is, a nozzle plate 101 has a nozzle opening surface 101*b* covered with a protection layer 102 made from a metal or the like for protecting nozzle opening portions. The protection layer 102 has through holes 103 and 107 which actually serve as nozzle openings.

As schematically shown in FIG. 27A and FIG. 27B, a first nozzle portion 104 serving as a quantitative medium nozzle provided in the nozzle plate 101 has a crescent-shaped cross section over its entire length, whereas a second nozzle portion 106 serving as a discharge nozzle has a circular cross section over its entire length. Note that the first nozzle portion 104 is formed with an inclination with respect to the thickness direction of the nozzle plate 101, so as to approach the opening of the second nozzle portion 106. The circular through hole 103 is formed at a position corresponding to the first nozzle portion 104 in the protection layer 102, and the circular through hole 107 is provided at a position corresponding to the second nozzle portion 106 in the protection layer 102.

That is, the through hole 103 having a circular cross section and provided at the position corresponding to the first nozzle portion 104 actually serves as an opening portion of the quantitative medium nozzle which has a crescent-shaped cross section along a line orthogonally crossing the center line of the quantitative nozzle. The through hole 107 provided at the position corresponding to the second nozzle substantially serves as the opening portion of the discharge medium nozzle.

The quantitative medium nozzle and the discharge medium nozzle formed in the aforementioned resin plate by eximer laser processing do not always have a sufficient mechanical strength and may be damaged by an operation of a blade which is generally used in the ink-jet printer. Taking consideration on such a situation, the protection layer 101 protects the first nozzle portion and the second nozzle portion which substantially open at a lower position than the surface of the protection layer 101, and prevents the nozzles from being mechanically damaged.

Each of the through holes 103 and 107 in the protection layer may be filled with a meniscus of the quantitative medium and the discharge medium, respectively, because of the physical characteristics of quantitative medium and the discharge medium such as a surface tension and the wettabiility of the nozzle opening surface 101*b* and the protection layer 102. In this case, the substantial opening portion of the quantitative nozzle and the discharge medium are circular has been described above. In spite of this, the quantitative medium is pushed at a velocity of several tens of centimeters to several meters per second in the crescent shape and tends to form a sphere, i.e., actually a hemisphere by its surface tension. This force can be utilized to orient the quantitative medium toward the discharge medium nozzle.

Figure 28:
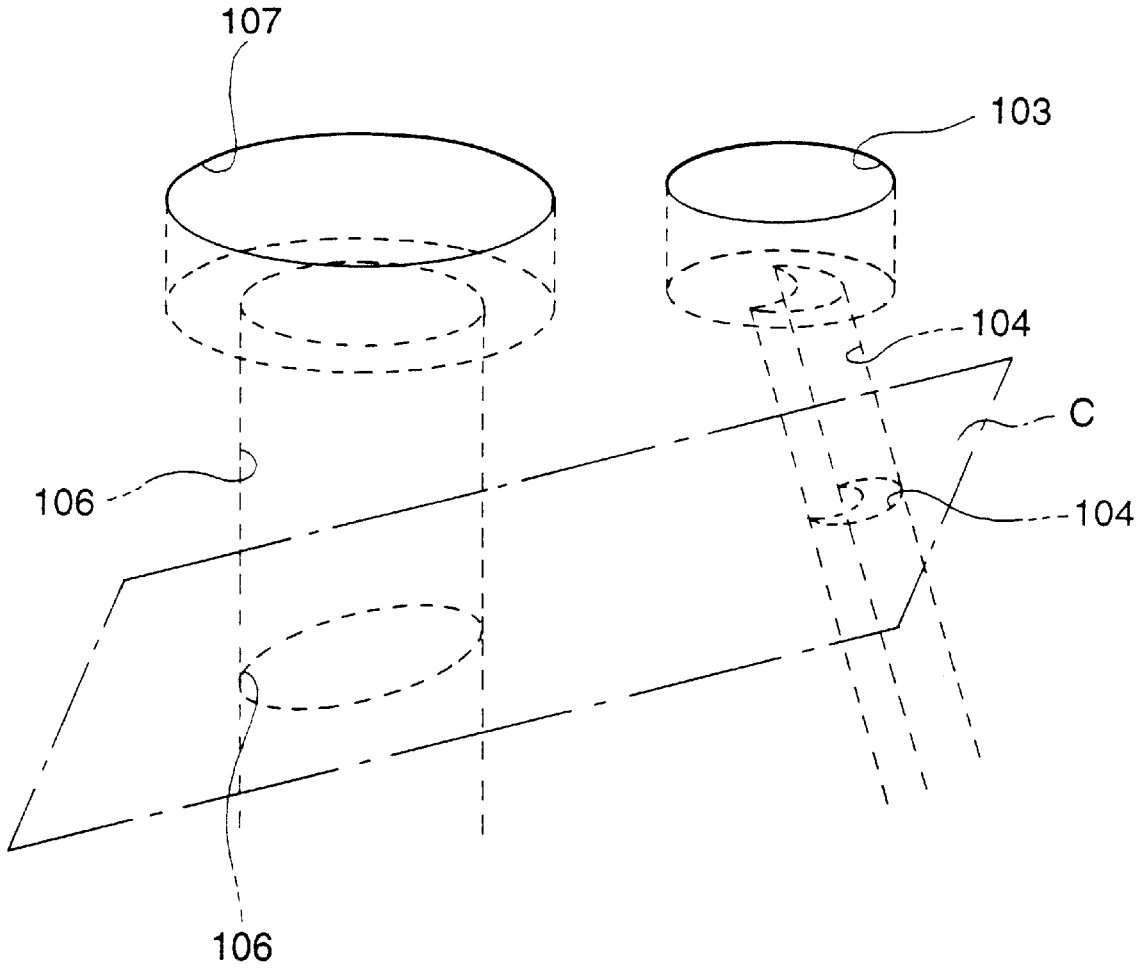
FIG. 28 is a perspective view which schematically shows the first nozzle and the second nozzle of the printing head according to the yet still further modification of the present invention.

In the printer according to the present embodiment, as schematically shown in FIG. 28, in the cross section C which orthogonally crosses the center line of the first nozzle portion 104 serving as the quantitative medium nozzle, the relationship between the cross-sectional shape of the first nozzle portion 104 serving as the quantitative medium nozzle and the cross-sectional shape of the second nozzle portion 106 serving as the discharge medium nozzle is similar to the relationship shown in FIG. 8 and FIG. 9. Thus, the quantitative medium is oriented toward the discharge medium nozzle.

However, this effect of orientation becomes zero when the hemispheric shape is complete. After this, the quantitative medium seeps out toward the discharge medium nozzle by the inertia of the preceding motion of the liquid and the flow vector generated by the inclination of the quantitative medium nozzle toward the discharge medium nozzle.

Figure 29A:
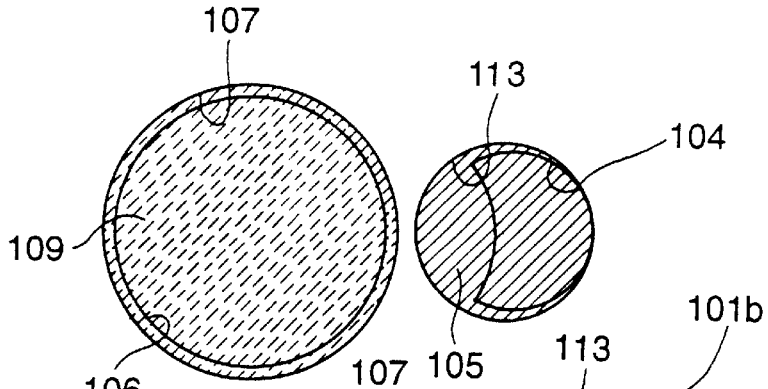
FIG. 29A is a plan view and FIG. 29B is a cross sectional view which schematically show the first nozzle and the second nozzle of the printing head according to the yet still further modification of the present invention.
Figure 29B:
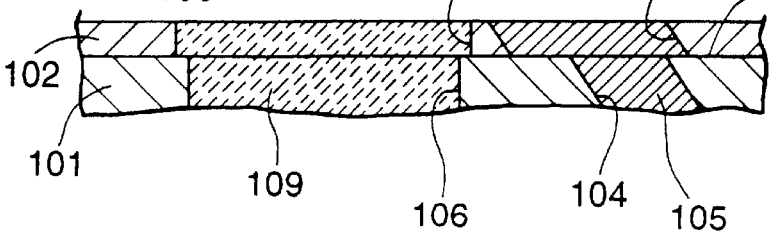

FIG. 29 shows another configuration of the printing head of the printer according to the present invention, which configuration is similar to the configuration shown in FIG. 27, and is characterized in that a through hole 113 provided in the protection layer 102 at a position corresponding to the first nozzle 1 serving as the quantitative medium nozzle is formed with an inclination with respect to the thickness direction of the protection layer 102. The other portions are the same as in the configuration shown in FIG. 27, and their explanations are omitted. That is, in this printer, similar effects can be obtained as in the printer shown in FIG. 27.

Consequently, it is possible to make the quantitative medium seep out toward the discharge medium nozzle if the quantitative medium nozzle has such an opening shape and/or has at least a portion with such a shape of a cross section orthogonally crossing the center line of the nozzle that a distance from the center of the inscribed circle to the nearest end point on the discharge medium nozzle is greater than the distance from the center of the circumscribed circle to the nearest end point on the discharge medium nozzle.

However, in this embodiment, such effects are decreased if the nozzle opening portion is too long, i.e., if the protection layer is too thick. Moreover, the effects are increased when the portion having a crescent cross section is in the vicinity of the opening.

What has been described above will now be explained from a different point of view. Liquid when floating in a space or in another liquid having no compatibility tends to form a sphere of the smallest surface area when the liquid is in the most stable state. If the liquid is in a form other than the sphere, it tends to become a hemisphere and finally becomes a sphere which is the most stable state.

When liquid is attached to a solid body, a hemisphere (or an almost hemispheric form) is the most stable state. If the solid body has a small surface tension, i.e., if the solid body has a high liquid repellence, a so-called contact angle becomes greater and the hemisphere approaches a sphere. On the contrary, when the solid body has a great surface tension, i.e., if the solid body has a small liquid repellence, the contact angle becomes smaller and the hemisphere becomes more flat. If the liquid is in a form other than the hemisphere, it tends to become a hemisphere. If no factors of prevention such as a contamination on the surface are present, the liquid finally becomes a hemisphere which is the most stable state.

Consequently, if liquid attached to a solid surface is made into a form distorted from a hemisphere, the liquid tends to form a hemisphere. The present invention utilizes this property of liquid. That is, the quantitative medium is pushed out of the quantitative medium nozzle in a non-circular form or in a form distorted from an isotropic form so that the quantitative medium tends to form a hemisphere to minimize its surface area by the surface tension by itself, seeping out toward the discharge medium nozzle.

This effect is especially increased when the quantitative medium is pushed out in a hemispheric or an isotropic form having an indentation facing the discharge medium nozzle.

According to the present invention, there is also such a effect that a significantly small quantity of the quantitative medium can be mixed. That is, in a case when the quantitative medium is an ink liquid and the discharge medium is diluent, there is a possibility to realize a lower concentration.

In order to supply the quantitative medium to the discharge medium, it is necessary that the quantitative medium pushed out break to seep out in the direction from the quantitative medium nozzle to the discharge medium nozzle. If the quantitative medium remains as forming a meniscus without breakage to spread out, the quantitative medium returns into the quantitative medium nozzle when the pressure from the quantitative medium chamber is reduced.

When the quantitative medium is pushed out at the same flow rate, the quantitative medium from a crescent shape of the nozzle breaks earlier than the quantitative medium from an elliptic shape of the nozzle. In other words, the minimum quantity required for breakage is smaller when the crescent shape is used, and a smaller quantity of the discharge medium can be mixed with the discharge medium.

For confirming this effect, the following test was carried out. That is, a quantitative medium nozzle having an elliptic opening and a quantitative medium nozzle having a crescent opening were used so as to check the gradation step characteristics.

The voltage (0 to 10 [V]) of the first layered piezoelectric device was divided into 16 steps for pushing out the quantitative medium for printing patterns of 16 concentration gradation steps, and the reflection concentration was determined for each of the gradation steps. The quantitative medium was ink and the discharge medium was diluent.

Figure 30:
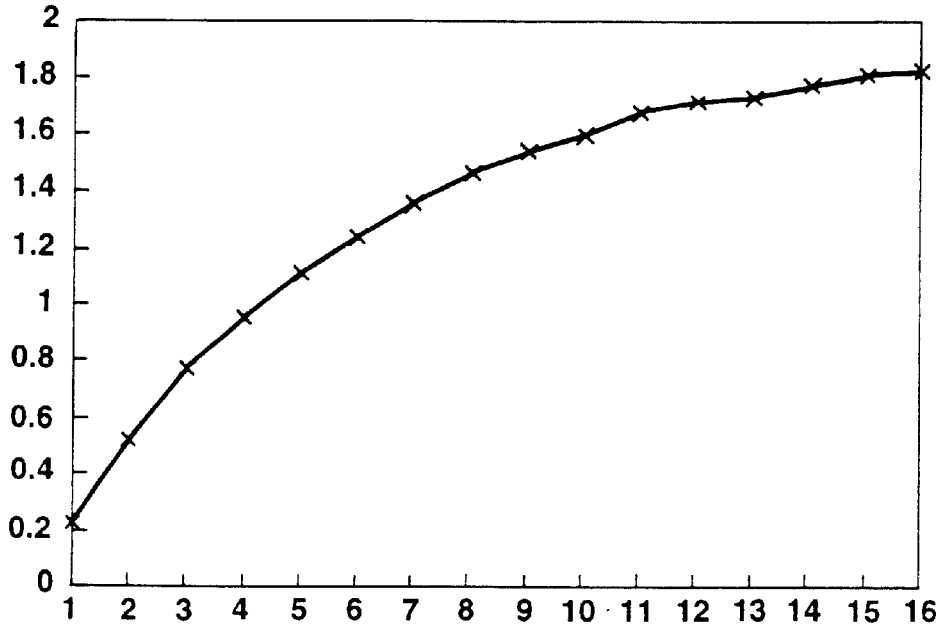
FIG. 30 shows an example of relationships between the gradation steps and the reflection concentrations.
Figure 31:
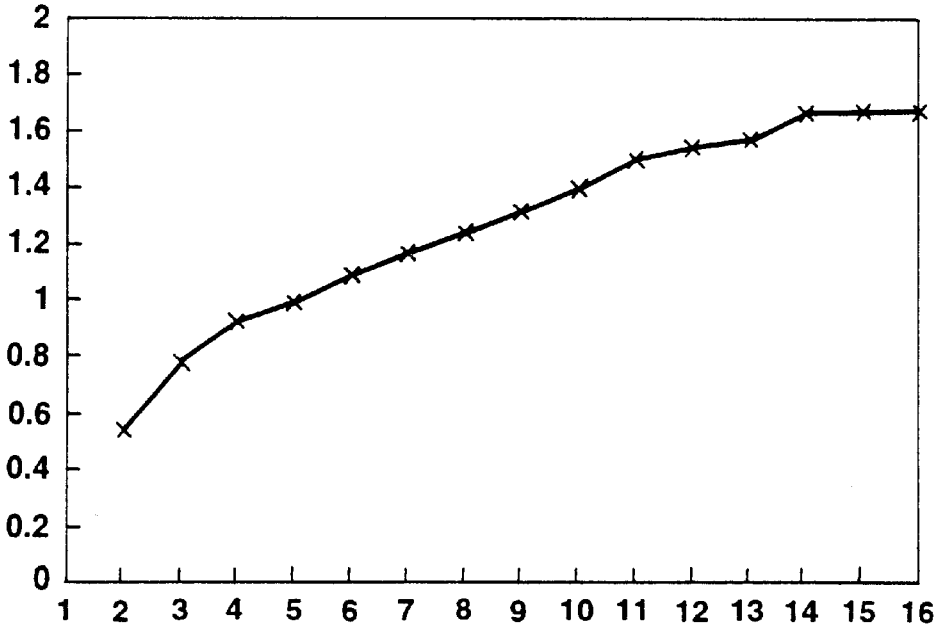
FIG. 31 shows another example of relationships between the gradation steps and the reflection concentrations.

FIG. 30 shows results of the crescent opening of the quantitative medium nozzle and FIG. 31 shows the results of the elliptic opening of the quantitative medium. In FIG. 30 and FIG. 31, the horizontal axis represents the gradation step and the vertical axis represents the reflection concentration of the printed pattern. When FIG. 30 is compared to FIG. 31, it is clear that the crescent opening of the quantitative medium nozzle enables to obtain a more preferable control of the concentration including the lowest gradation step (lowest concentration). Thus, it is possible to realize printing of a lower concentration.

It should be noted that the aforementioned various examples may be employed in various combinations and can be modified in various ways within the scope of the present invention.

Although the aforementioned embodiment is serial type printer, the present invention can also be applied to a line type printer and a rotary type printer.

Figure 32:
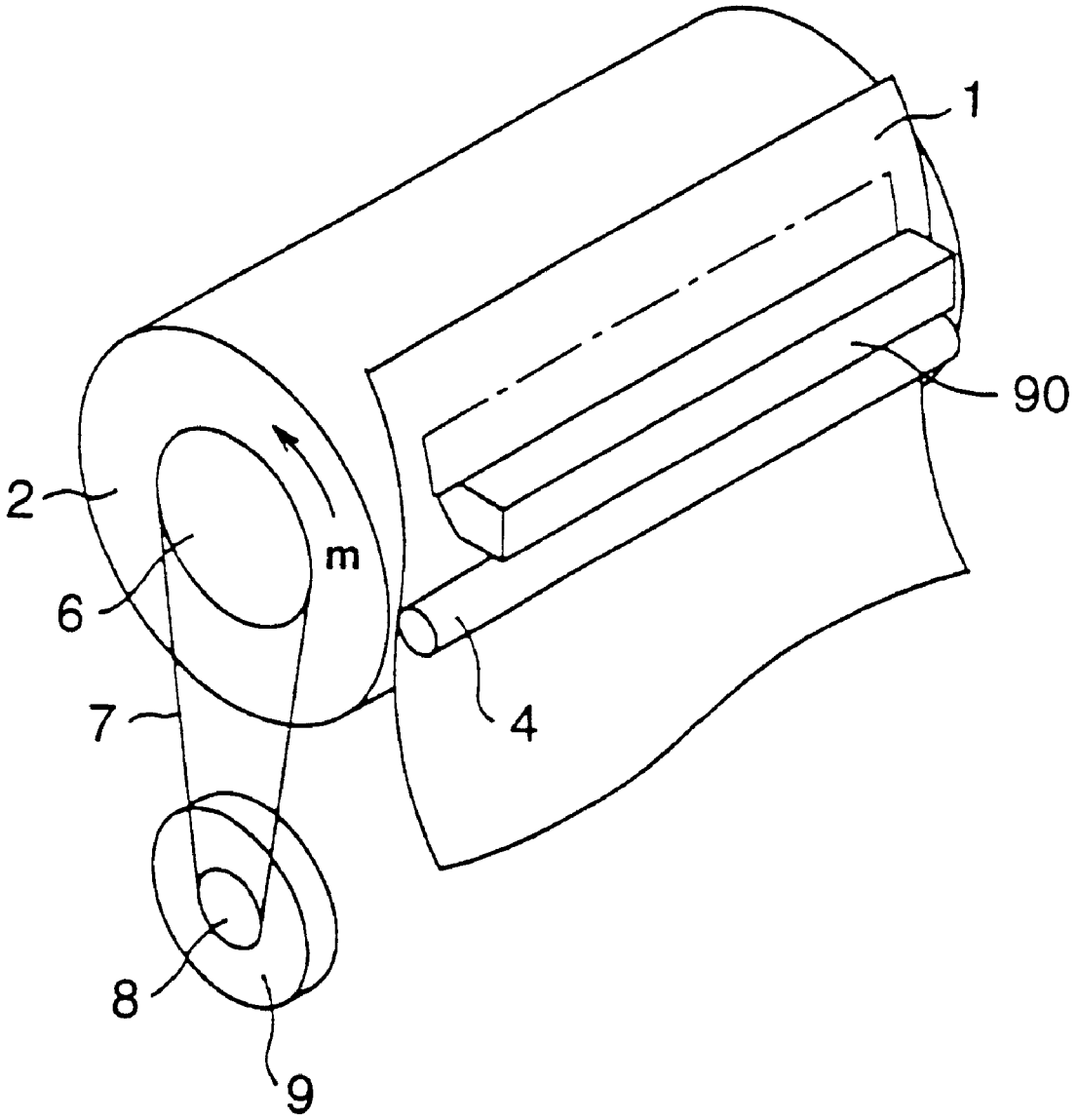
FIG. 32 is a schematic perspective view showing an essential portion of a printer according to another embodiment of the present invention.

FIG. 32 shows a configuration of the aforementioned line type printer. In this FIG. 32, components corresponding to the components of the printer of FIG. 1 are denoted with the same symbols, and their explanations are omitted. The control block is not depicted, either.

In this line type printer, a line head 90 consisting of a number of printing heads (not depicted) is fixed in the direction of a shaft of a drum 2. In this line type printer, the line head 90 simultaneously carries out printing of one line. When a line printing is complete, the drum 2 is rotated by one line in the direction indicated by an arrow "m" in the figure so that a following line can be printed. In this case, it is possible to carry out printing by the entire line all at once or by several blocks divided or alternately for every other line.

Figure 33:
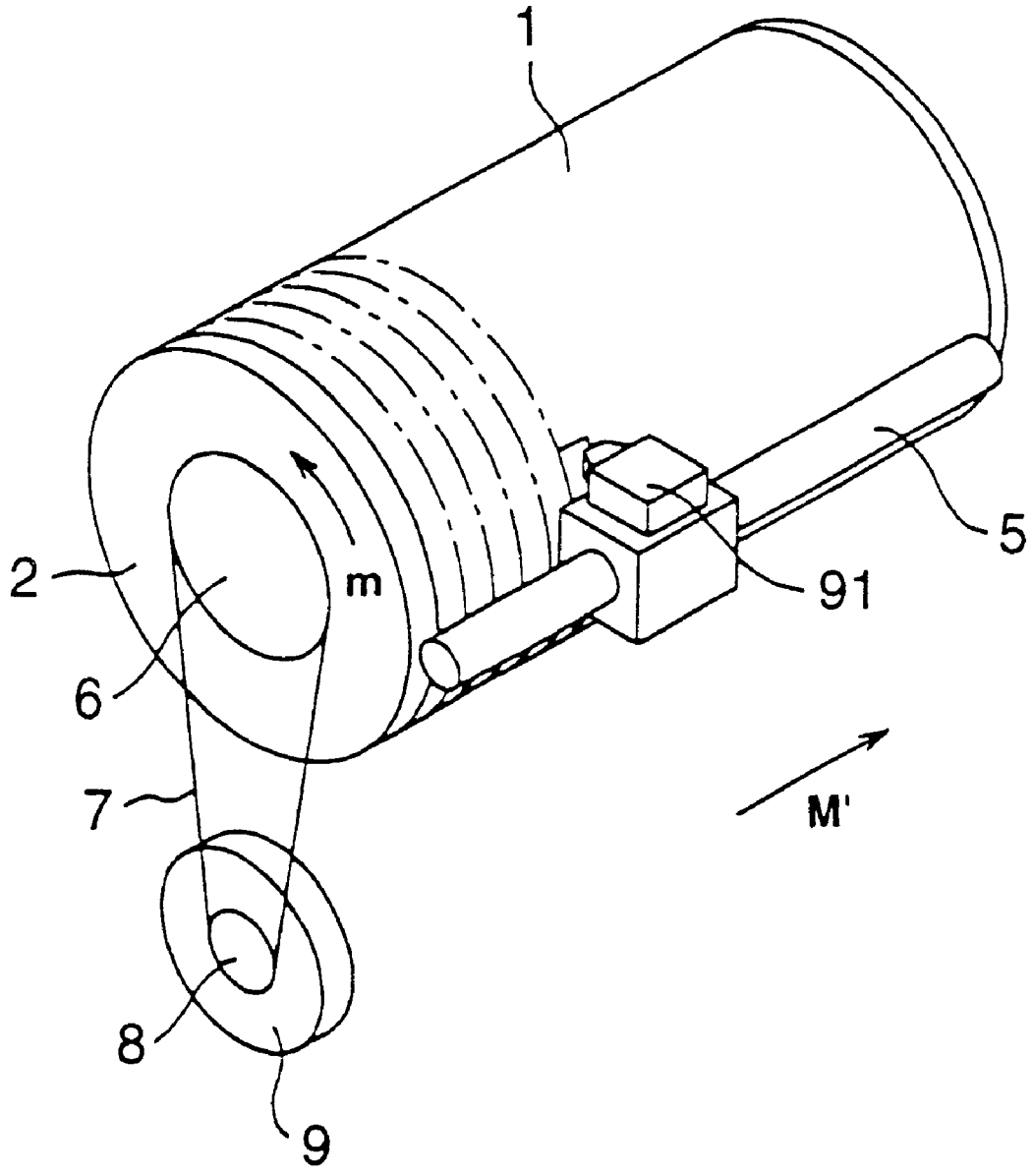
FIG. 33 is a schematic perspective view showing an essential portion of a printer according to still another embodiment of the present invention.

FIG. 33 shows a configuration of the drum rotary type printer. In this FIG. 33, components corresponding to the components of the printer of FIG. 1 are denoted with the same symbols, and their explanations are omitted. The control block is not depicted, either. In this printer, when the drum 2 is rotated, the printing head 91 discharges ink for forming an image on the printing paper 1 in synchronization with the rotation of the drum 2. When the drum has made one turn in the direction of "m" in the figure and printing of one column is complete, the feed screw 5 rotates to move a printing head 91 by one pitch in the direction indicated by an arrow M' for printing a following column. In this case, it is also possible to simultaneously rotate the drum 2 and the feed screw 5 so that the printing head 91 is gradually moved while carrying out a printing. In the case of a multi-head type or one section is to be printed repeatedly several times, a spiral state of printing is carried out by interlocking the drum 2 with the feed screw 5.

As can be understood from the explanation above, in the printer according to an aspect of the present invention, a quantitative medium nozzle for pushing out a quantitative medium is provided separately from a discharge medium nozzle for discharging a discharge medium. Consequently, during a wait period of time, the quantitative medium will not be brought into contact with the discharge medium, and they are assured to be separated from each other. Moreover, during a mixing-discharging operation, no unnecessary flow-in of the quantitative medium and the discharge medium into wrong nozzles will not be caused.

In the printer according to another aspect of the present invention, the quantitative medium nozzle has an opening adjacent to an opening of the discharge medium nozzle. Consequently, the quantitative medium which seeps out from the quantitative medium nozzle is assured to be supplied to the discharge medium nozzle.

In the printer according to still another aspect of the present invention, the opening of the quantitative medium nozzle has such a configuration that the distance between the center of the circumscribed circle of this opening and the nearest point on the opening of the discharge medium nozzle is smaller than the distance between the center of the inscribed circle of this opening and the nearest point on the opening of the discharge medium nozzle. Consequently, the quantitative medium is assured to be pushed out toward the discharge medium nozzle.

In the printer according to yet another aspect of the present invention, the opening of the quantitative medium nozzle has such a configuration that the nearest point on the opening end of the quantitative medium nozzle from the center of figure faces the adjacent discharge medium nozzle. Consequently, the quantitative medium is further assured to be pushed out toward the discharge medium nozzle.

In the printer according to still yet another aspect of the present invention, the opening of the quantitative medium nozzle has such a configuration that a cut-off portion faces the discharge medium nozzle. Consequently, the quantitative medium is still further assured to be pushed out toward the discharge medium nozzle through this cut-off portion.

Therefore, in the printer according to the present invention, it is possible to completely prevent mixing of the quantitative medium with the discharge medium during a wait period of time, thus enabling to mix the discharge medium with an accurate quantity of the quantitative medium according to a gradation step, so as to express the gradation step accurately.

It should be noted that when the opening of the quantitative medium nozzle has the aforementioned configuration, the quantitative medium is still further assured to be pushed out toward the discharge medium nozzle on the condition that the discharge medium nozzle opening and the quantitative medium nozzle are arranged symmetrically with respect to a line connecting the center of the discharge medium nozzle opening and the center of the quantitative medium opening when the cut-off portion is restored.

What is claimed is:

1. A printing device comprising:

a discharge medium pressure chamber charged with a discharge medium;

a quantitative medium pressure chamber charged with a quantitative medium;

a discharge nozzle communicated with said discharge medium pressure chamber, said discharge nozzle having an opening and an opening plane;

a plurality of quantitative nozzles communicated with said quantitative medium pressure chamber, each of said plurality of quantitative nozzles having an opening adjacent to each other; and a printing head configured to supply said quantitative medium from said plurality of quantitative nozzles to said discharge nozzle so that said quantitative medium and said discharge medium are mixed at said opening plane and ejected from said discharge nozzle, wherein said plurality of quantitative nozzles enclose said discharge nozzle and said openings of said plurality of quantitative nozzles adjacent said opening of said discharge nozzle.

2. The printing device in claim 1, wherein said discharge nozzle has a circumference and said plurality of quantitative nozzles are substantially equally spaced on the circumference.

3. The printing device as claimed in claim 2, wherein cut-outs are provided in the opening of each of said plurality of quantitative nozzles adjacent said discharge nozzle.

* * * * *